United States Patent [19]

Hanko

[11] Patent Number: 5,037,026

[45] Date of Patent: Aug. 6, 1991

[54] CLOSABLE CARTON WITH IMPROVED SNAP ACTION LOCK

[75] Inventor: Jimmy J. Hanko, Lexington, Ky.

[73] Assignee: Gulf States Paper Corporation, Tuscaloosa, Ala.

[21] Appl. No.: 625,161

[22] Filed: Dec. 10, 1990

[51] Int. Cl.[5] ..... B65D 43/02

[52] U.S. Cl. ..... 229/125.29; 229/114; 229/115; 229/148; 229/150

[58] Field of Search ..... 229/108, 114, 115, 125.27, 229/125.28, 125.29, 148, 150

[56] References Cited

U.S. PATENT DOCUMENTS

| | | | |
|---|---|---|---|
| 2,701,090 | 2/1955 | Buttery | 229/115 |
| 3,010,638 | 11/1961 | Forrer | 229/125.29 |
| 3,410,475 | 11/1968 | Wagner | 229/125.29 |
| 3,795,360 | 3/1974 | Bianchi et al. | 229/125.27 |
| 4,809,908 | 3/1989 | Keefe et al. | 229/150 |
| 4,856,707 | 8/1989 | Lorenz | 229/125.29 |
| 4,877,178 | 10/1989 | Eisman | 229/114 |
| 4,930,681 | 6/1990 | Fultz et al. | 229/125.29 |

*Primary Examiner*—Gary E. Elkins

*Attorney, Agent, or Firm*—Cushman, Darby & Cushman

[57] ABSTRACT

A carton erected from carton material in cut and scored blank form, the carton comprising a lower tray structure comprising a bottom wall having flap connected tray side walls folded upwardly from the bottom wall, and an easy-open easy-close cover structure having a top wall having flap connected cover side walls folded from the bottom wall including a corner wall extending from the top wall between two adjacent spaced apart end edges of two adjacent cover side walls within a plane extending at an angle with respect to the angularly related planes of the two adjacent cover side walls. The cover structure is retained in closed relation by an opening formed in the corner wall and tabs formed from a portion of carton material defining the tray structure at the interconnection of the two adjacent tray side walls. The corner wall includes a portion of carton material extending downwardly and outwardly from the opening in a position to be interengaged during the closing movement with the tabs such that a relative one carton material deflection takes place by virtue of the interengagement and is freed with a snap action when the cover structure reaches its closed position enabling the tabs to extend upwardly and outwardly through the opening.

26 Claims, 16 Drawing Sheets

64
70
88
58
78
92
84
86
68
90
56
62
76
82
60
80
74
66
12
44
52
38
36
28
22
40
24
18
54
30
46
34
50
20
42
94
96
32
26
48

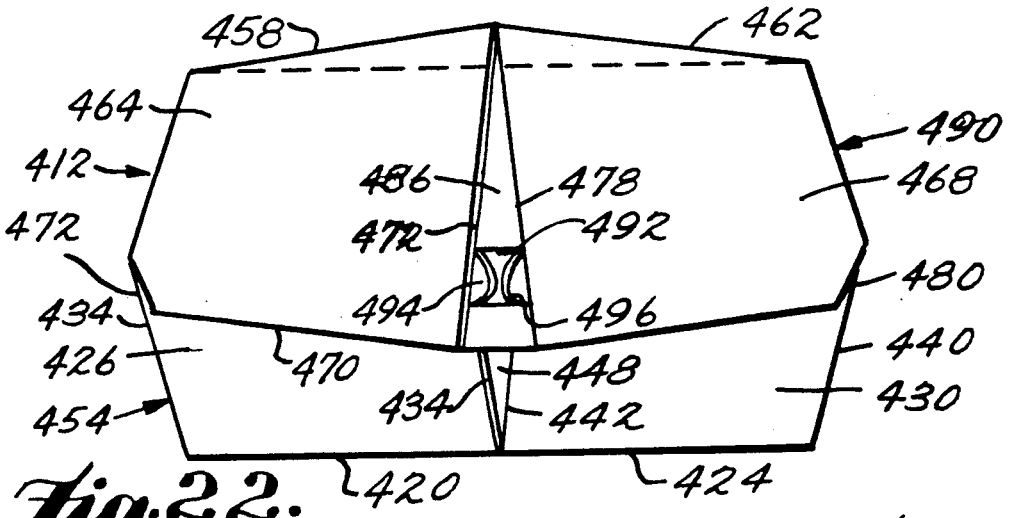
Fig.22.
Fig.23.
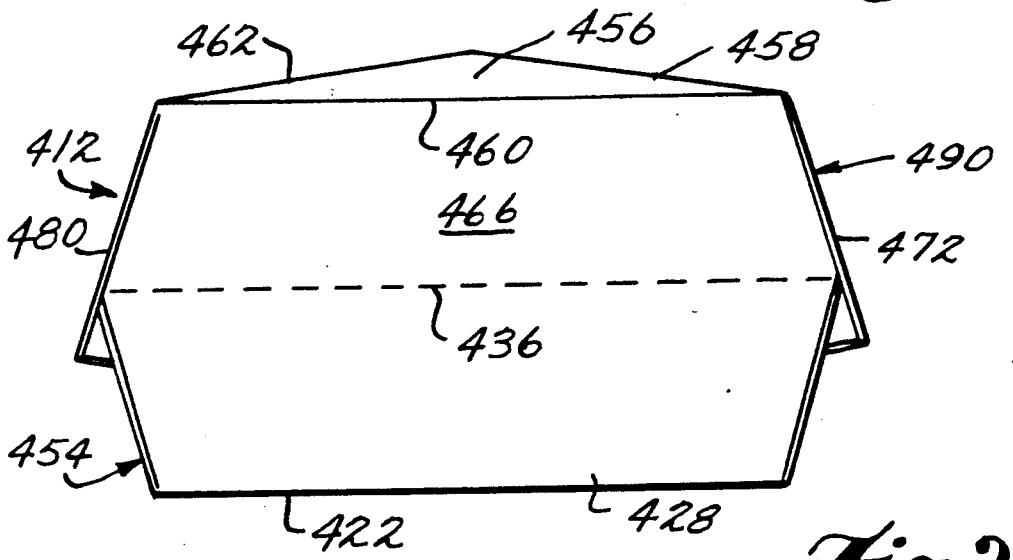
Fig.24.
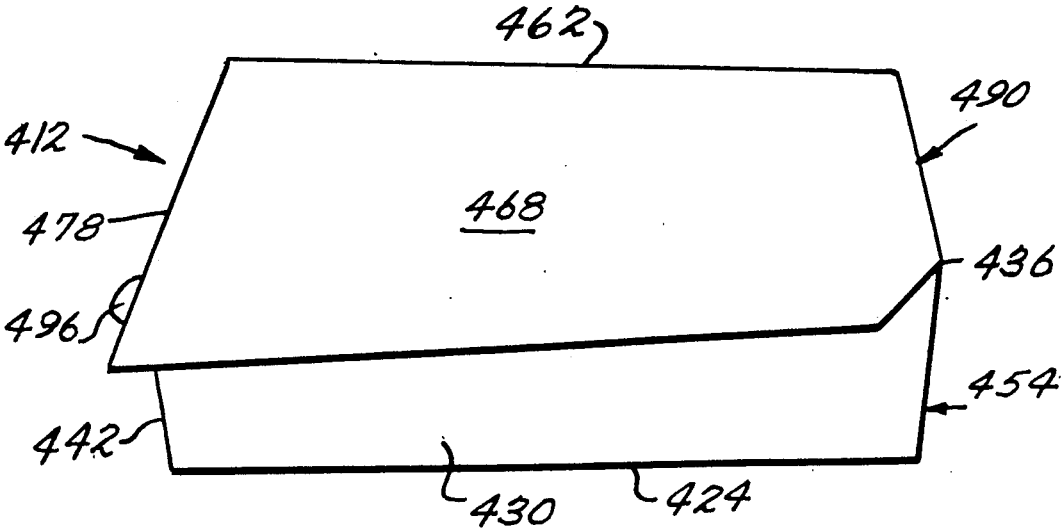

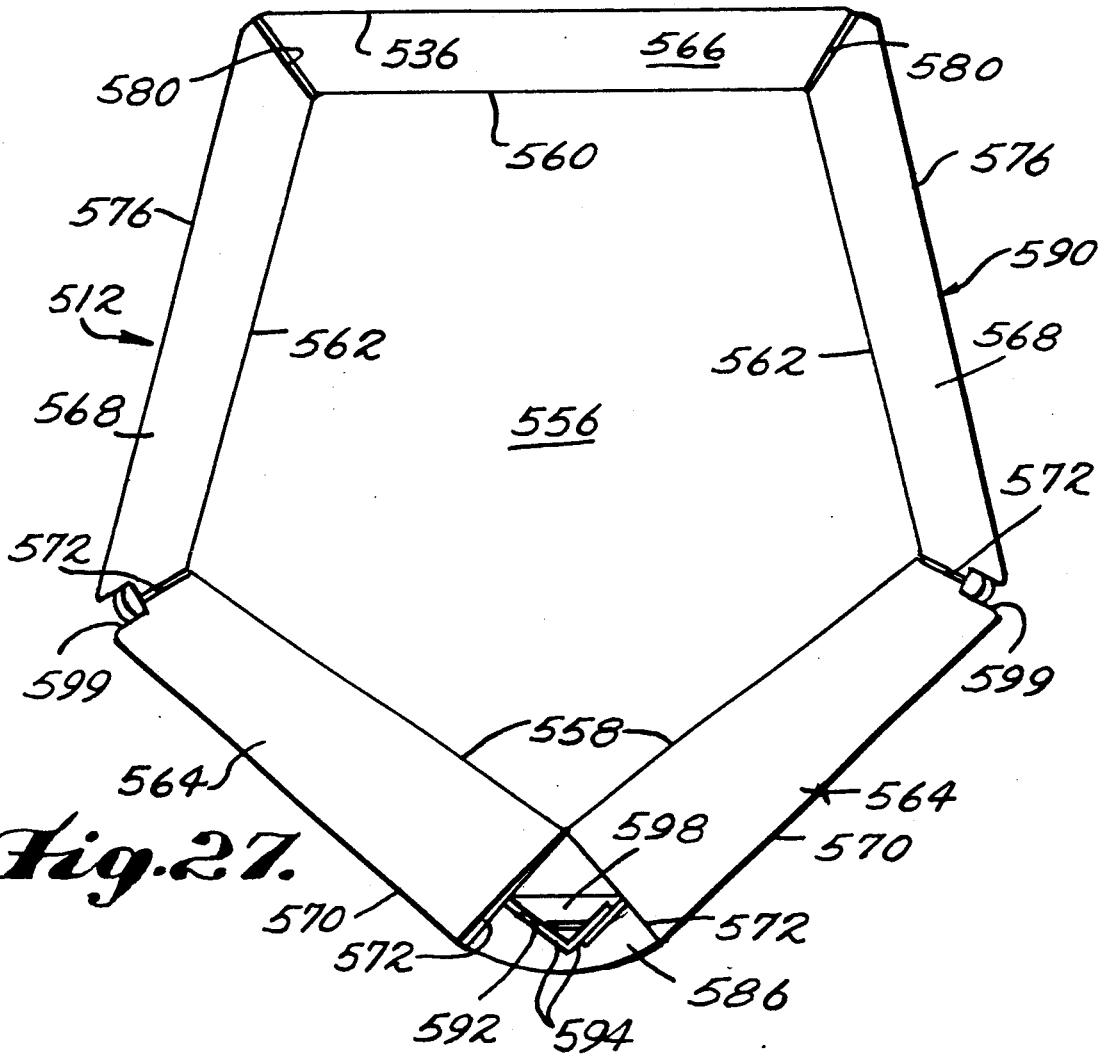
Fig. 27.
Fig. 28.
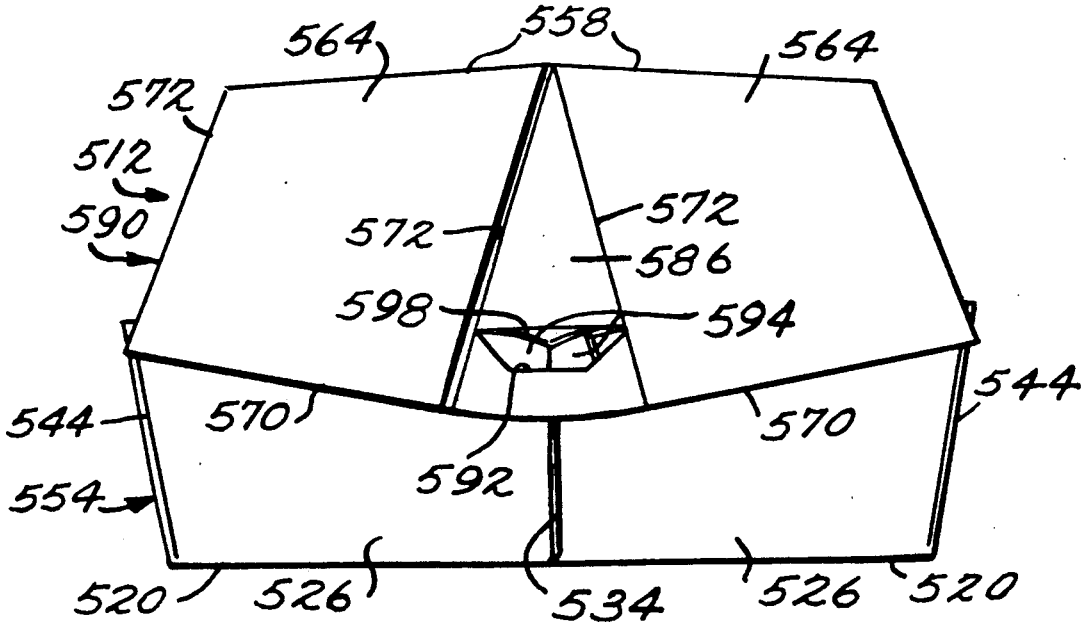

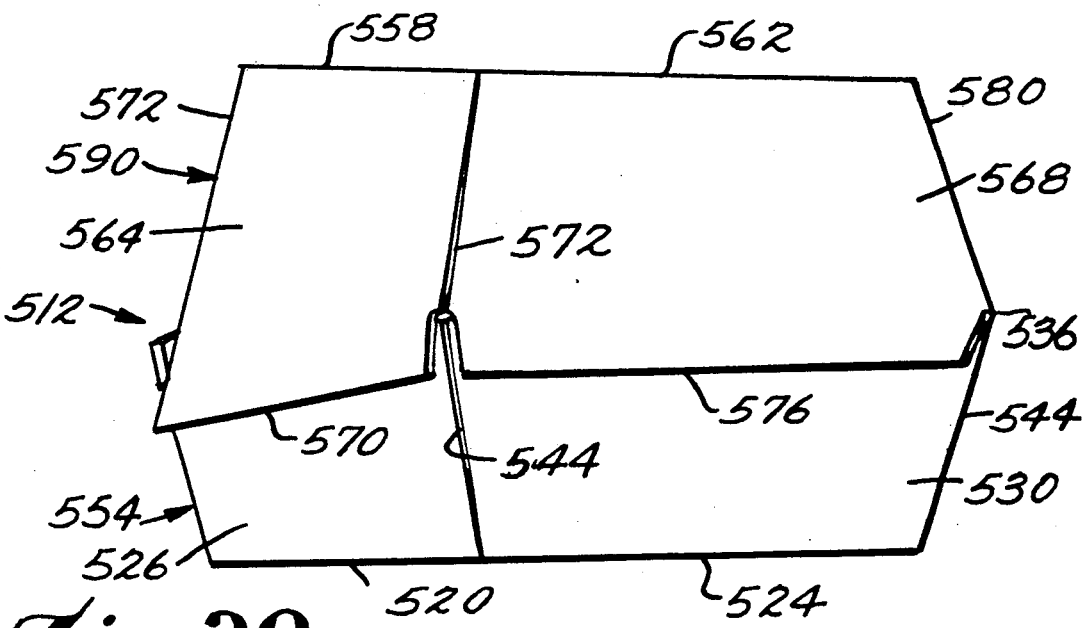
Fig. 29.
Fig. 30.
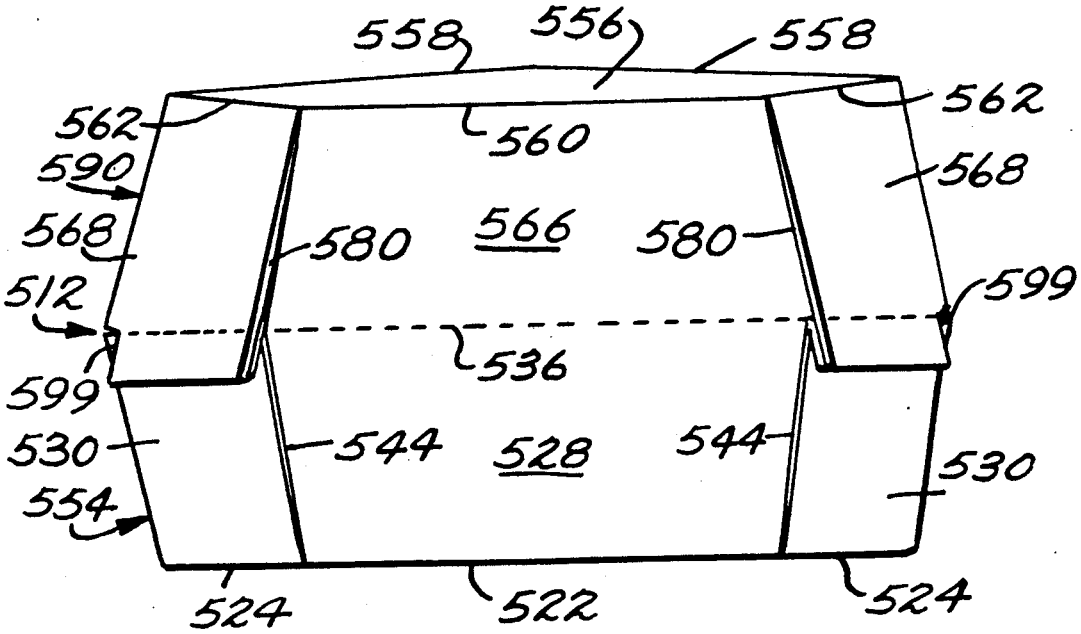

598
592
584
572
570
570
564
564
586
558
588
599
578
599
583
583
578
556
568
568
562
562
590
576
576
582
560
582
580
574
566
574
580
512
544
536
528
538
544
538
522
552
552
530
530
554
540
524
524
540
518
550
550
534
534
526
520
526
532
532
534
553
596
594

CLOSABLE CARTON WITH IMPROVED SNAP ACTION LOCK

This invention relates to cartons and more particularly to cartons of the easily opened and closed type.

There are many situations wherein it is desirable to utilize a carton which can be easily closed for presentation to a user and easily opened by the user. A good example is consumable products such as fast food and the like.

An example of a carton of the type herein contemplated is disclosed in U.S. Pat. No. 4,877,178. Cartons of the type herein contemplated usually provide a tray structure having an open top through which fast food can be placed in the tray structure and a cover structure for closing the open top of the tray structure after the food has been placed therein. The food is then presented to the user with the carton in a closed position requiring the user to manipulate the cover structure into an opened position. It is common practice for the fast food people to maintain a supply of empty cartons in a nested stacked relation. The cartons can be in one piece or the cover structures may be separate from the tray structures. In order to make the cartons cost effective, it is necessary to retain the cover structure in closed relation by means provided by the carton material itself. A problem in this regard is achieving just the right balance between the ease and effectiveness with which locking or closing securement can be accomplished and the ease and effectiveness with which unlocking or opening can be accomplished. There is always a need to provide a carton with improved locking and unlocking means which is cost effective and at the same time more nearly meets the desirable balanced characteristics noted above.

It is an object of the present invention to fulfill the need described above. In accordance with the principles of the present invention, this objective is accomplished by providing a carton erected from carton material in cut and scored blank form which comprises a lower tray structure comprising a bottom wall having a periphery defined by a plurality of straight edges, tray side walls folded upwardly from the straight edges of the bottom wall, and flaps interconnecting adjacent tray side walls so that upper edges thereof define an open top for the tray structure, and a cover structure for covering the open top of the tray structure when in a closed position with respect thereto. The cover structure in its closed position comprises a top wall having a periphery including straight edges corresponding to the straight edges of the bottom wall, and cover side walls folded downwardly from the straight edges of the bottom wall. Each of two adjacent depending side walls has a periphery including an upper edge folded from and common with an associated top wall edge, a lower free edge spaced from said upper edge and opposite end edges extending between the upper and lower edges thereof. The two adjacent cover side walls extend downwardly and outwardly from the top wall within angularly related planes with adjacent end edges in spaced apart relation. Flaps serve to interconnect the cover side walls, one of which provides a corner wall extending downwardly and outwardly from the top wall between the two adjacent spaced-apart end edges of the two adjacent cover side walls within a plane extending at an angle with respect to the angularly related planes of the two adjacent cover side walls. The corner wall and the two adjacent cover side walls extend downwardly and outwardly beyond the upper edges of two adjacent interconnected tray side walls. In order to (1) retain the cover structure in a closed position with respect to the open top of the tray structure and (2) enable the cover structure to be moved out of the closed position thereof to provide access to the tray structure through the open top thereof, an opening is formed in the corner wall and one or more tabs are formed from a portion of carton material defining the tray structure at the interconnection of the two tray side walls. The corner wall including a portion of carton material extending downwardly and outwardly from the opening therein is disposed in a position to be interengaged during the movement of the cover structure into its closed position with the portion of carton material defining the tabs such that at least one carton material portion of the two interengaging carton material portions deflects by virtue of the interengagement and is freed with a snap action when the cover structure reaches its closed position enabling the tabs to extend upwardly and outwardly through the opening to thereby yieldingly retain two adjacent depending cover side walls against general upward movement with respect to the associated two adjacent tray side walls.

The tray structure and the cover structure may either be separate or erected from a single cut and scored blank of carton material, in which case the cover structure includes an integral fold of carton material along (1) a lower edge of a cover side wall other than the two adjacent cover side walls and (2) an upper edge of an tray side wall other than the two adjacent cover side walls. Preferably, the tray structure and the cover structure are operable to be positioned in an opened position wherein the top wall is disposed in a common plane with the bottom wall. The angular inclinations of the side walls are such that the tray and cover structures whether separate or interconnected are operable to be disposed in a nested stacked relation with a plurality of similar tray and cover structures.

Another object of the present invention is the provision of a single blank or separate blanks which can be simply erected and are operable once erected to be provided an easy-open and easy-close carton which is simple in construction and cost effective.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
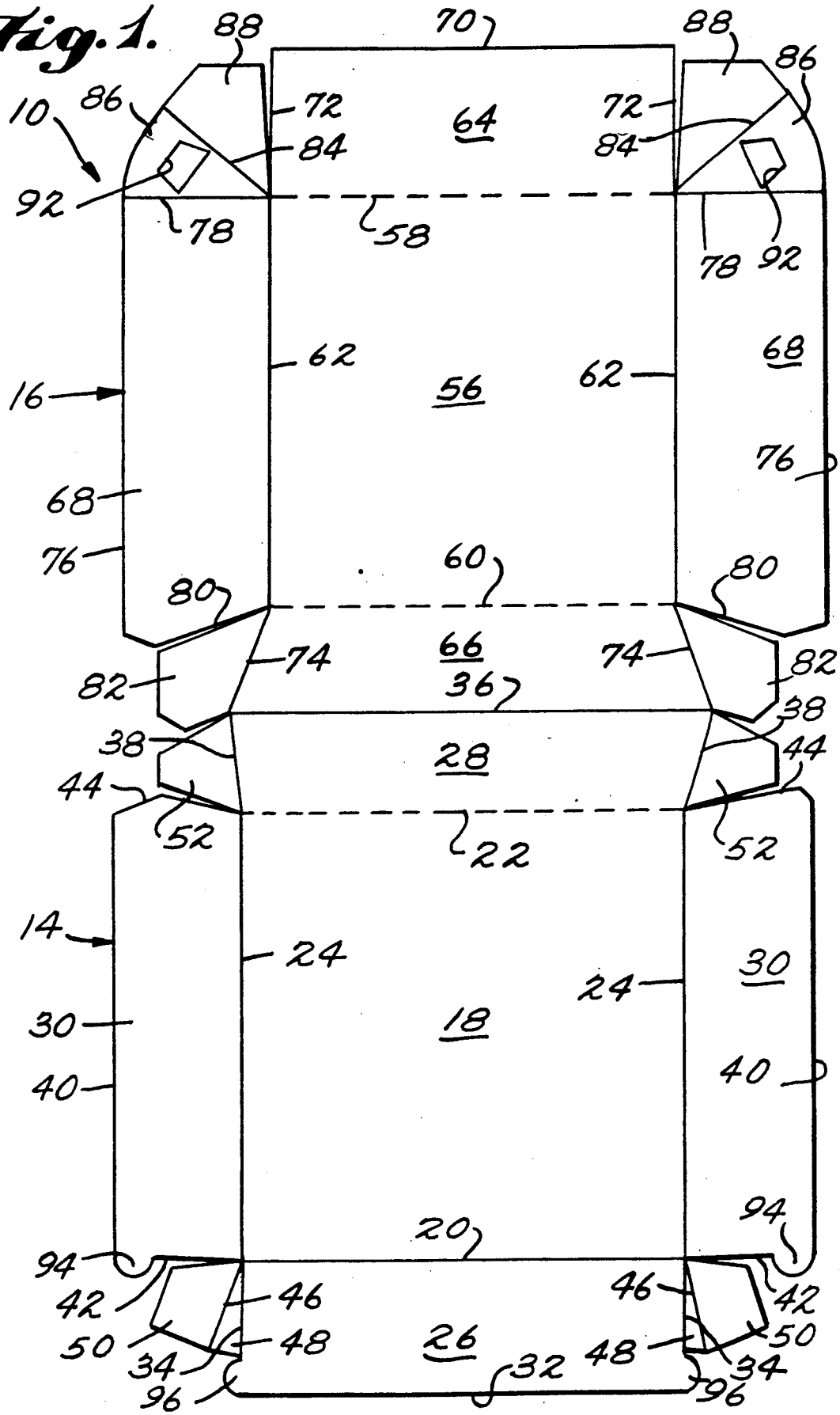
FIG. 1 is a top plan view of a single flat blank capable of being erected into a bottom tray structure and a cover structure pivotally mounted with respect to the tray structure for movement between open and closed positions embodying the principles of the present invention.
Figure 7:
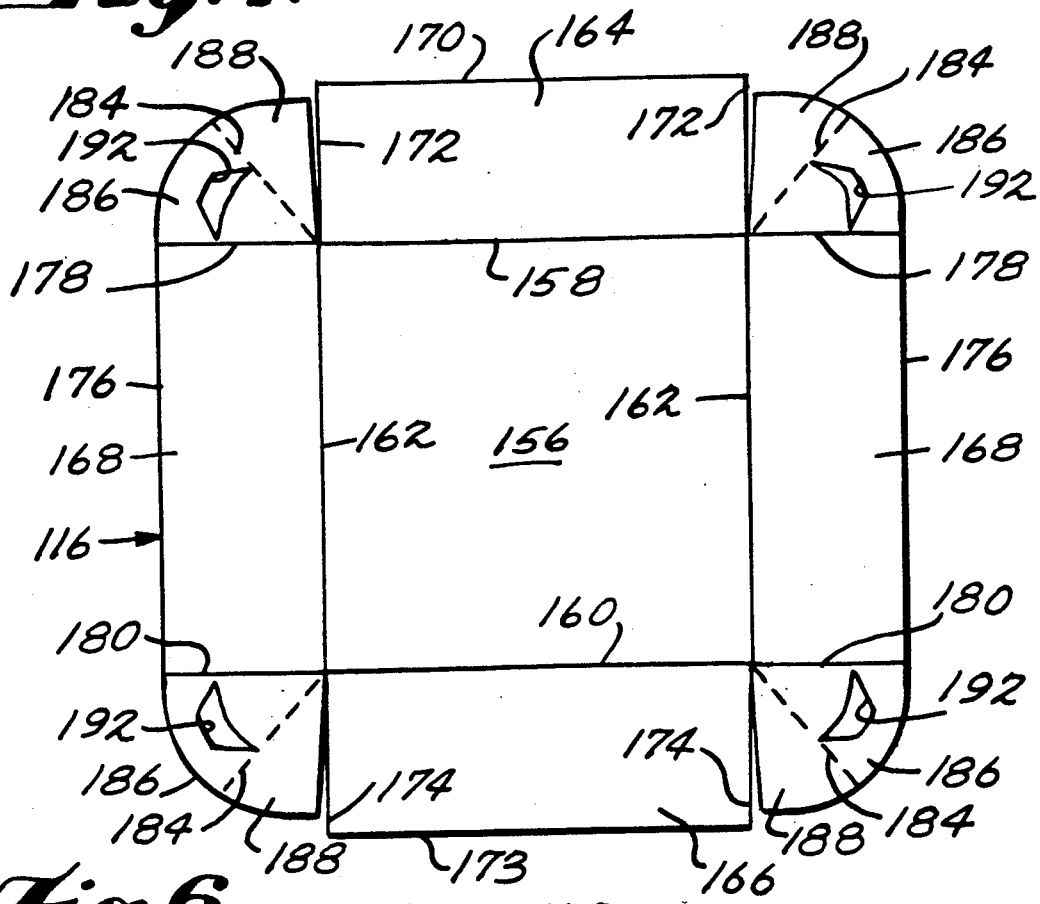
FIGS. 6 and 7 are top plan views of separate flat blanks operable to be erected into a bottom tray structure and a separable cover structure cooperable therewith embodying the principles of the present invention.
Figure 6:
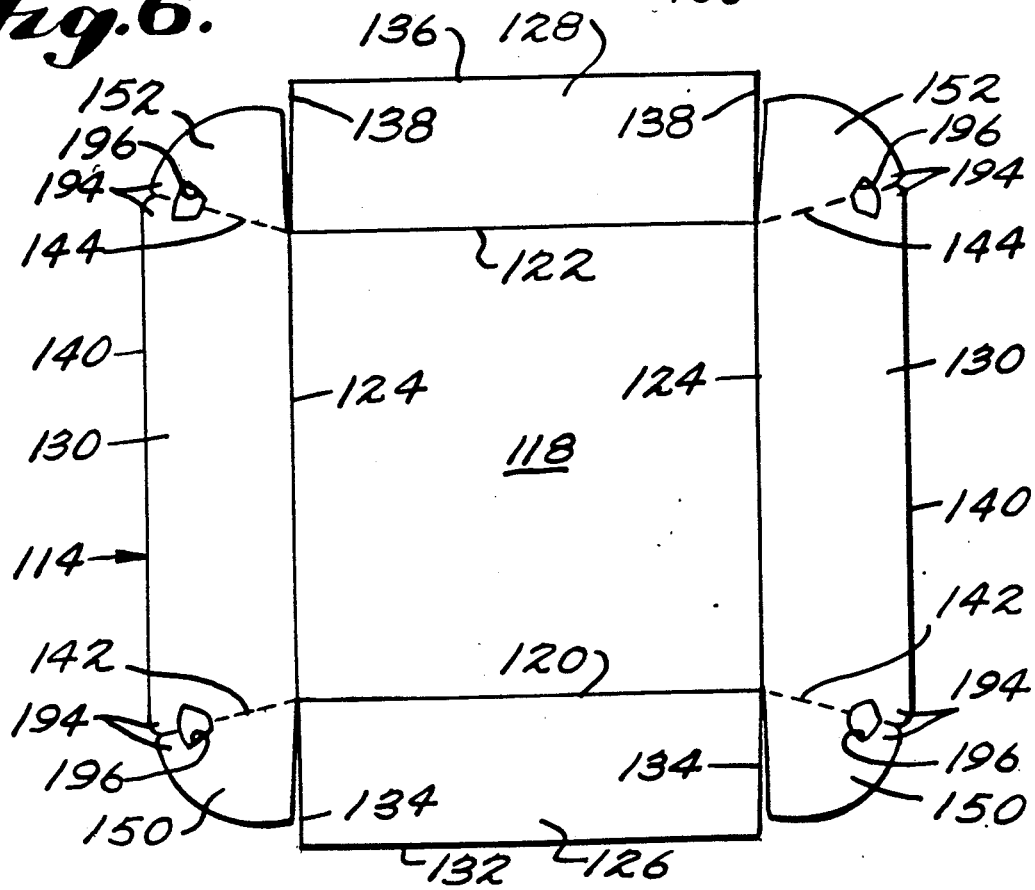
Figure 8:
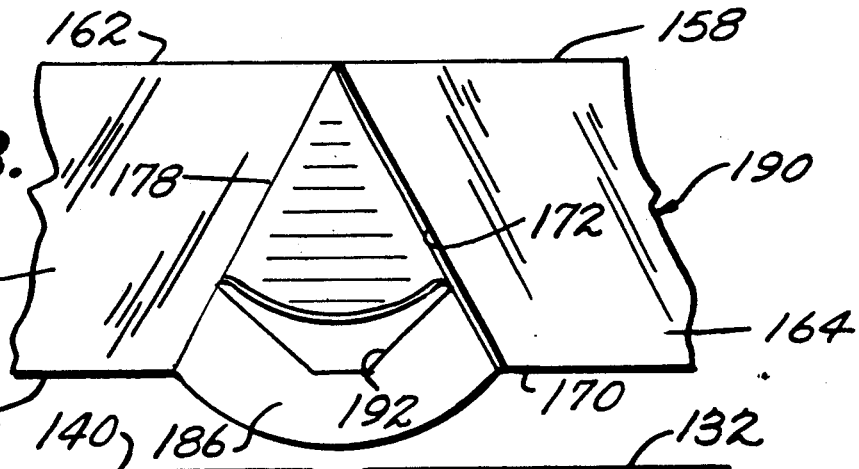
FIG. 8 is a fragmentary elevational view of a corner of the erected cover structure.
Figure 9:
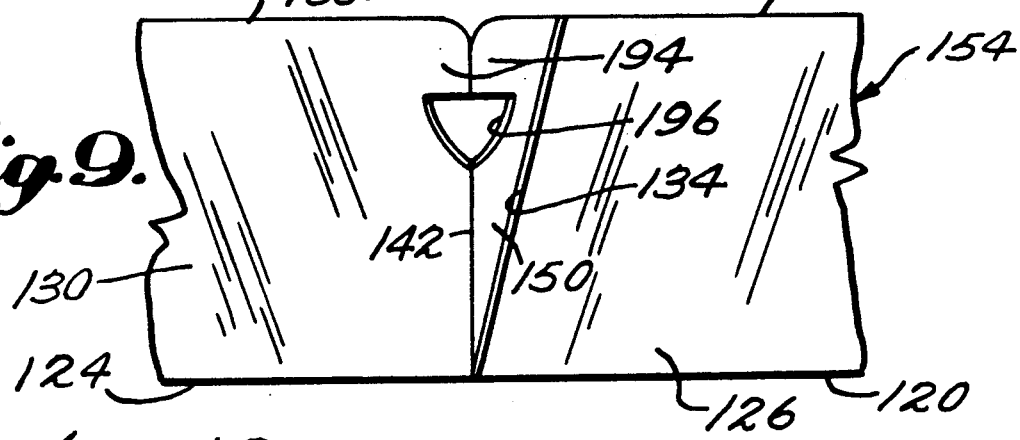
FIG. 9 is a corresponding corner view of the erected bottom tray structure.
Figure 10:
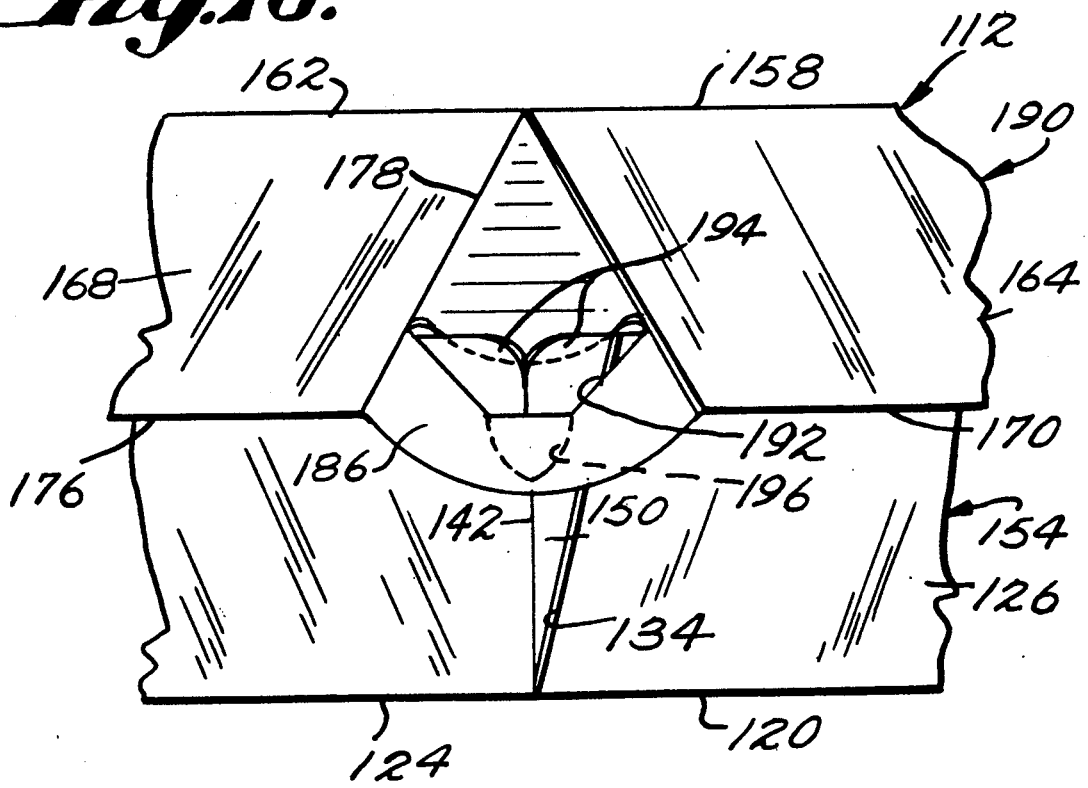
FIG. 10 is a view similar to FIGS. 8 and 9 showing the cover structure in closing relation to the bottom tray structure.
Figure 12:
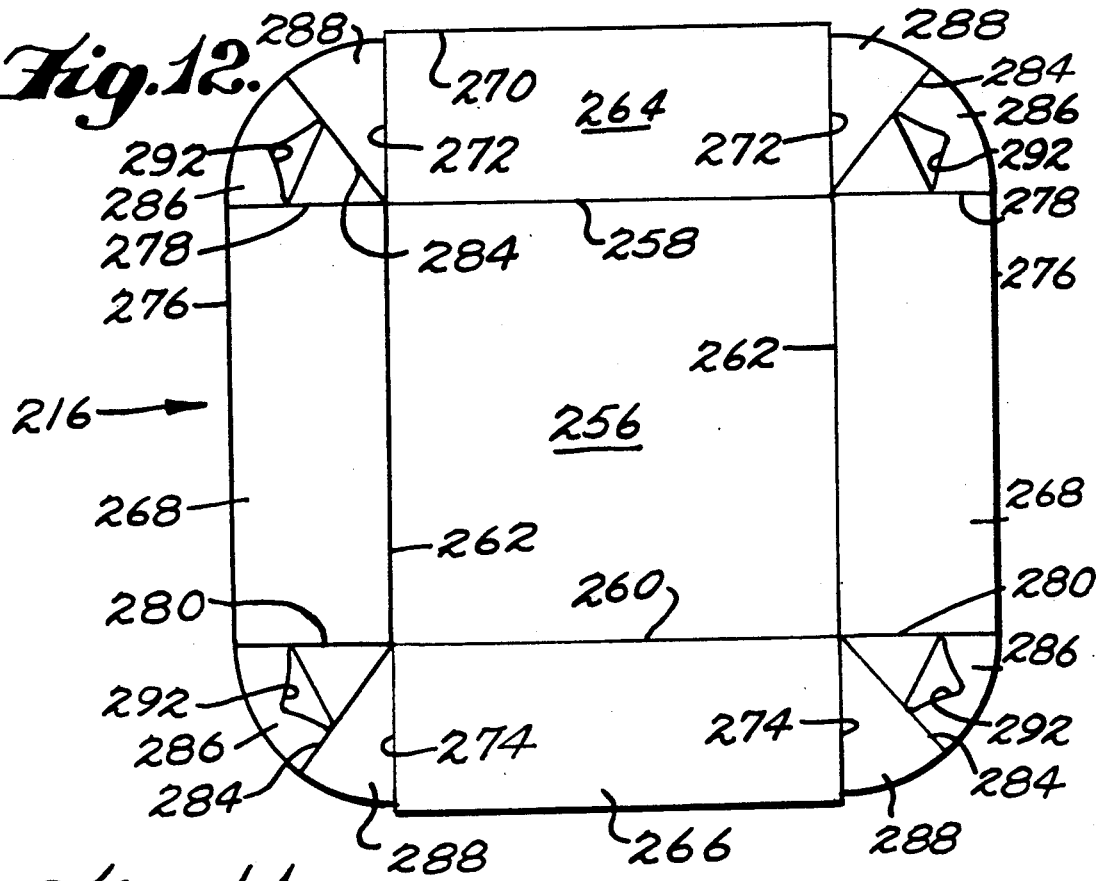
FIGS. 11 and 12 are views similar to FIGS. 6 and 7 respectively illustrating another embodiment of the present invention.
Figure 11:
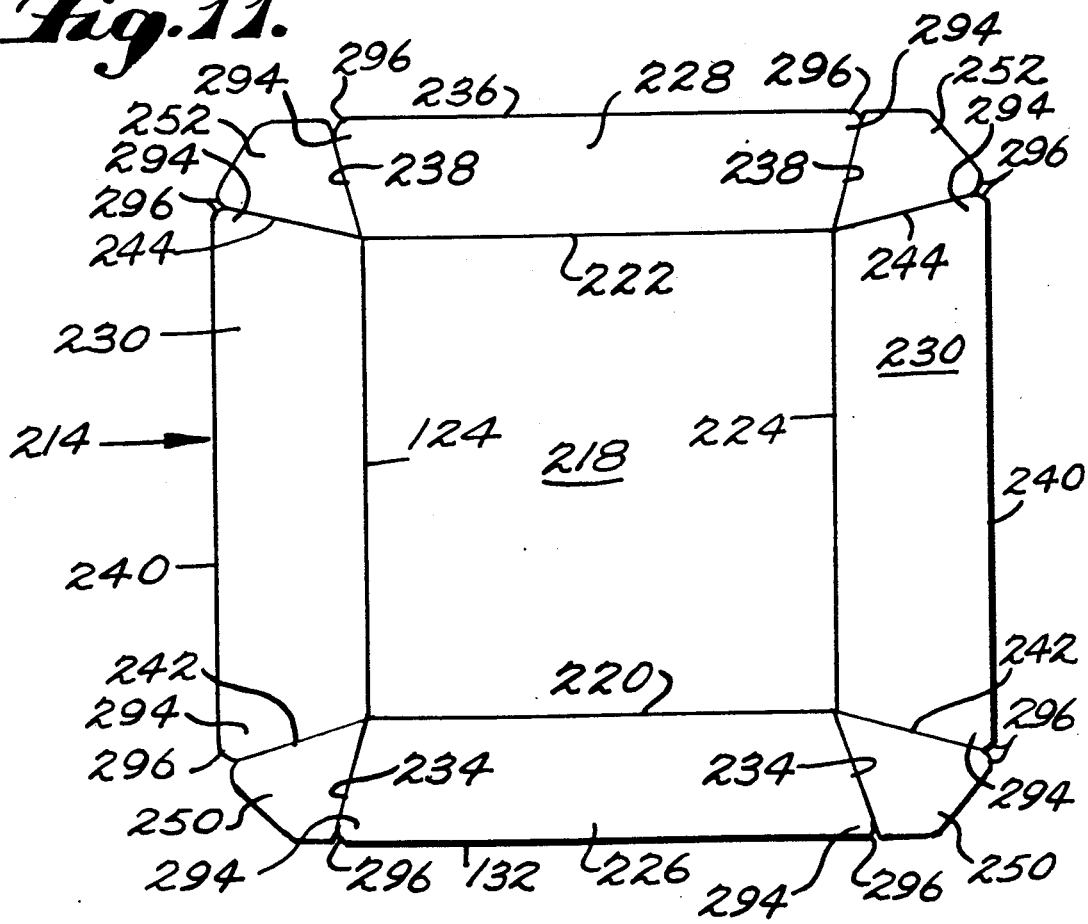
Figure 13:
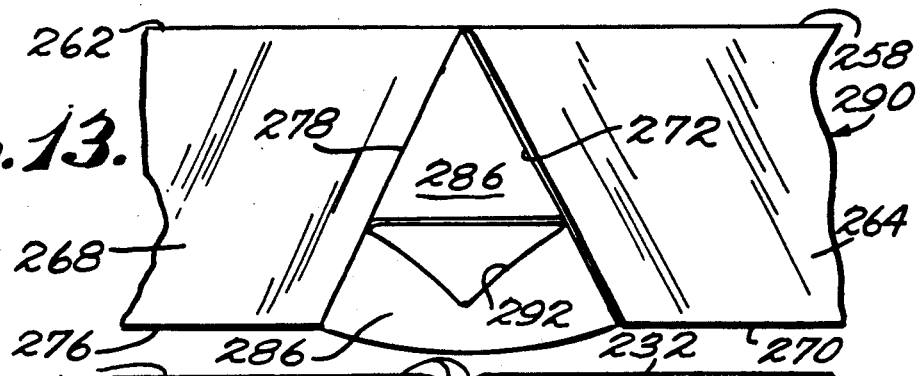
Figure 14:
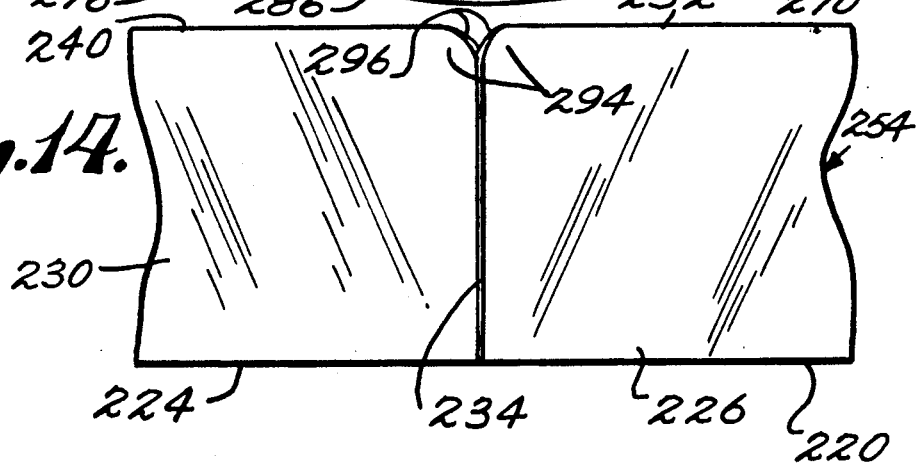
Figure 15:
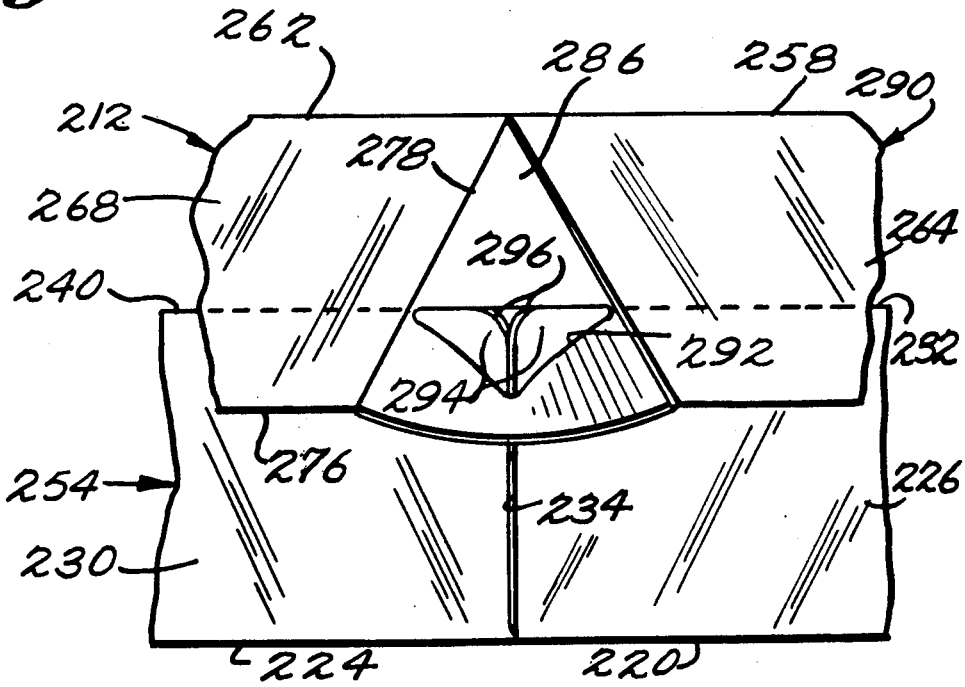
Figure 17:
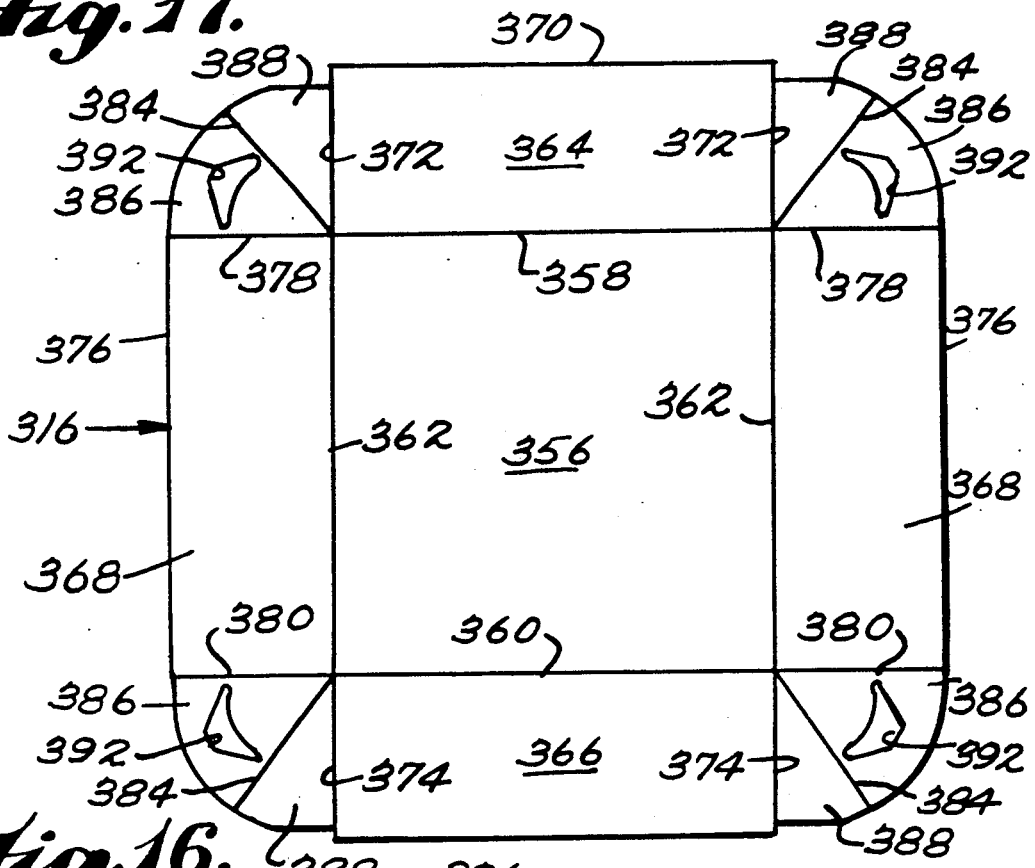
Figure 16:
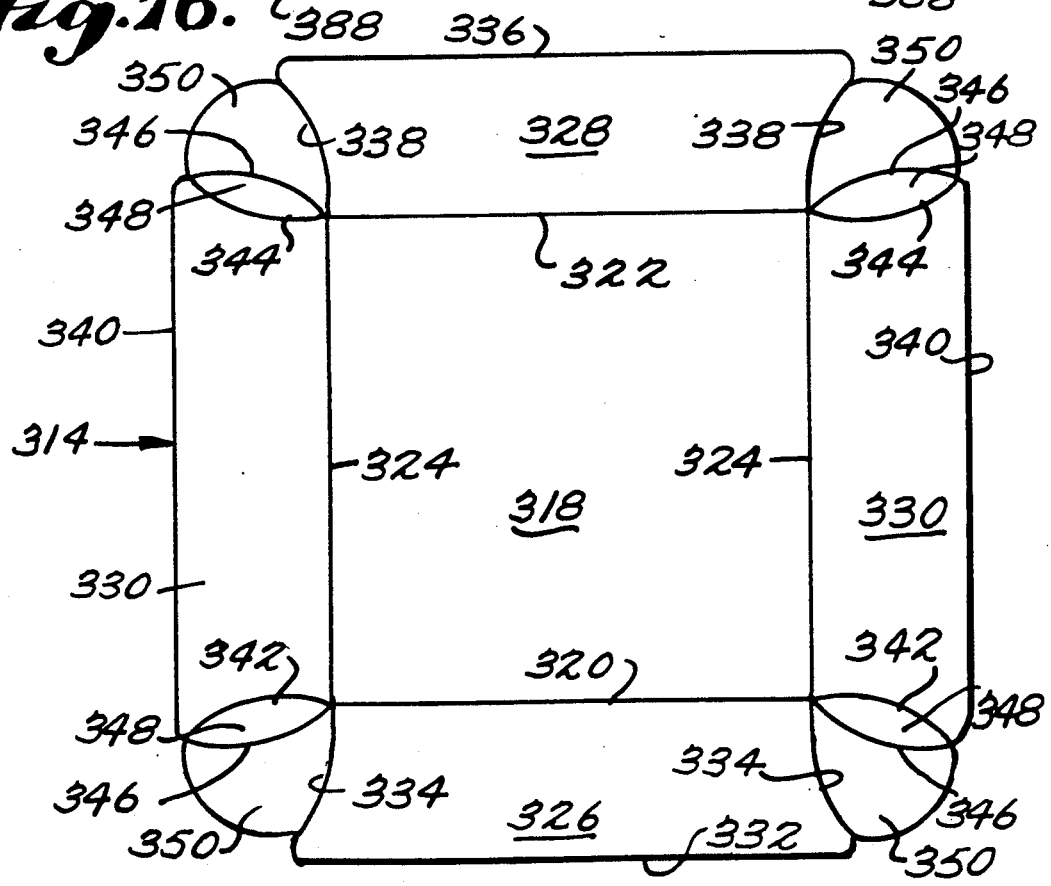
Figure 18:
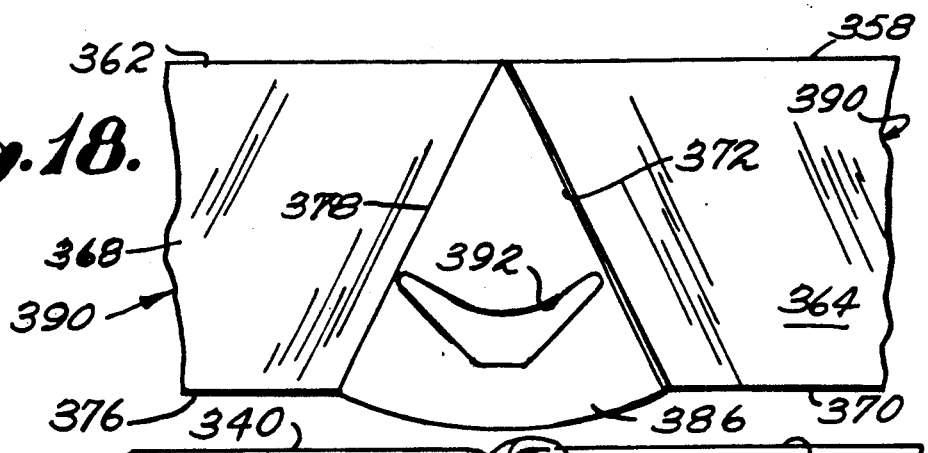
Figure 19:
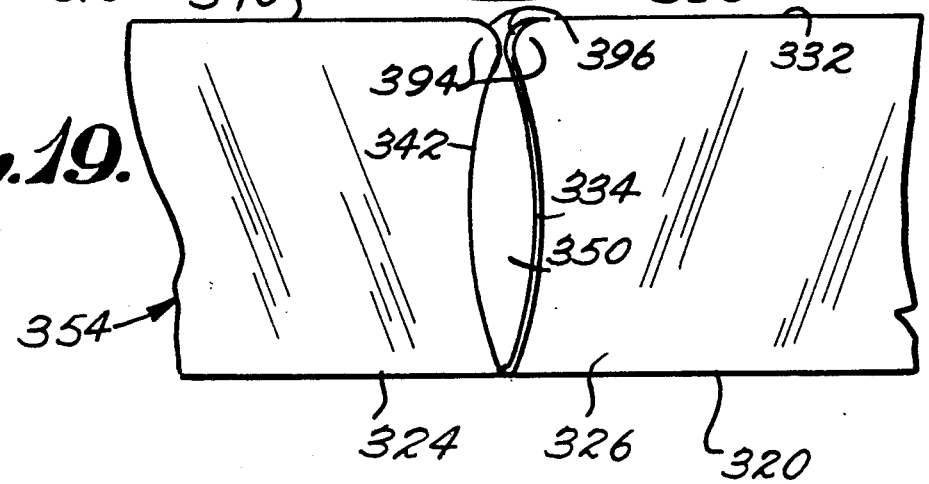
Figure 20:
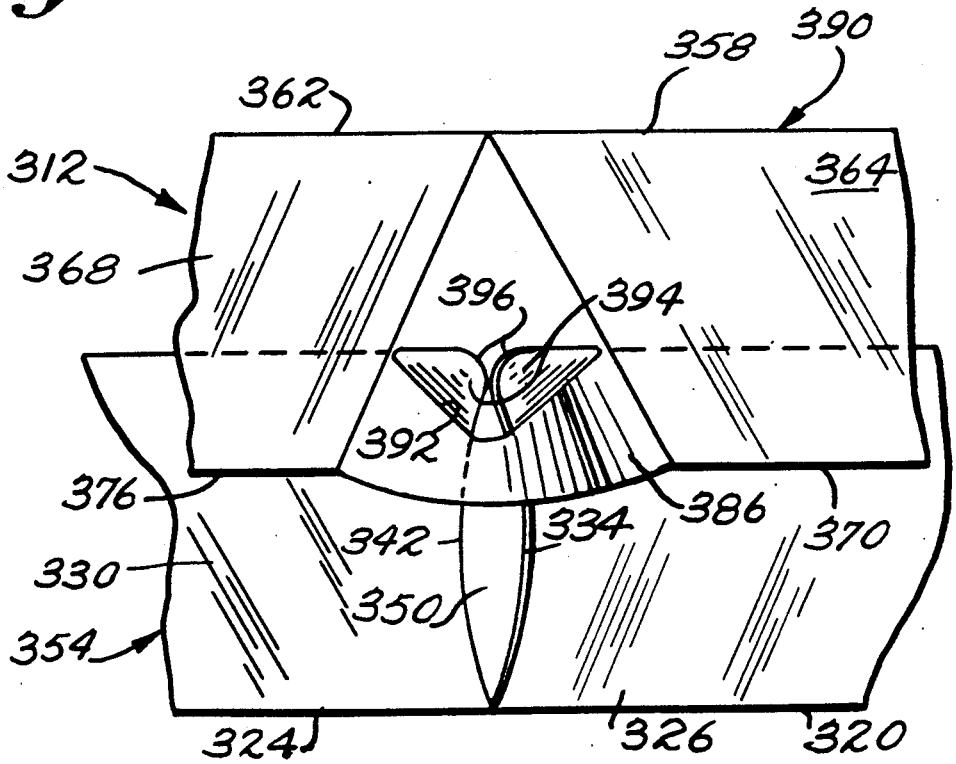
Figure 21:
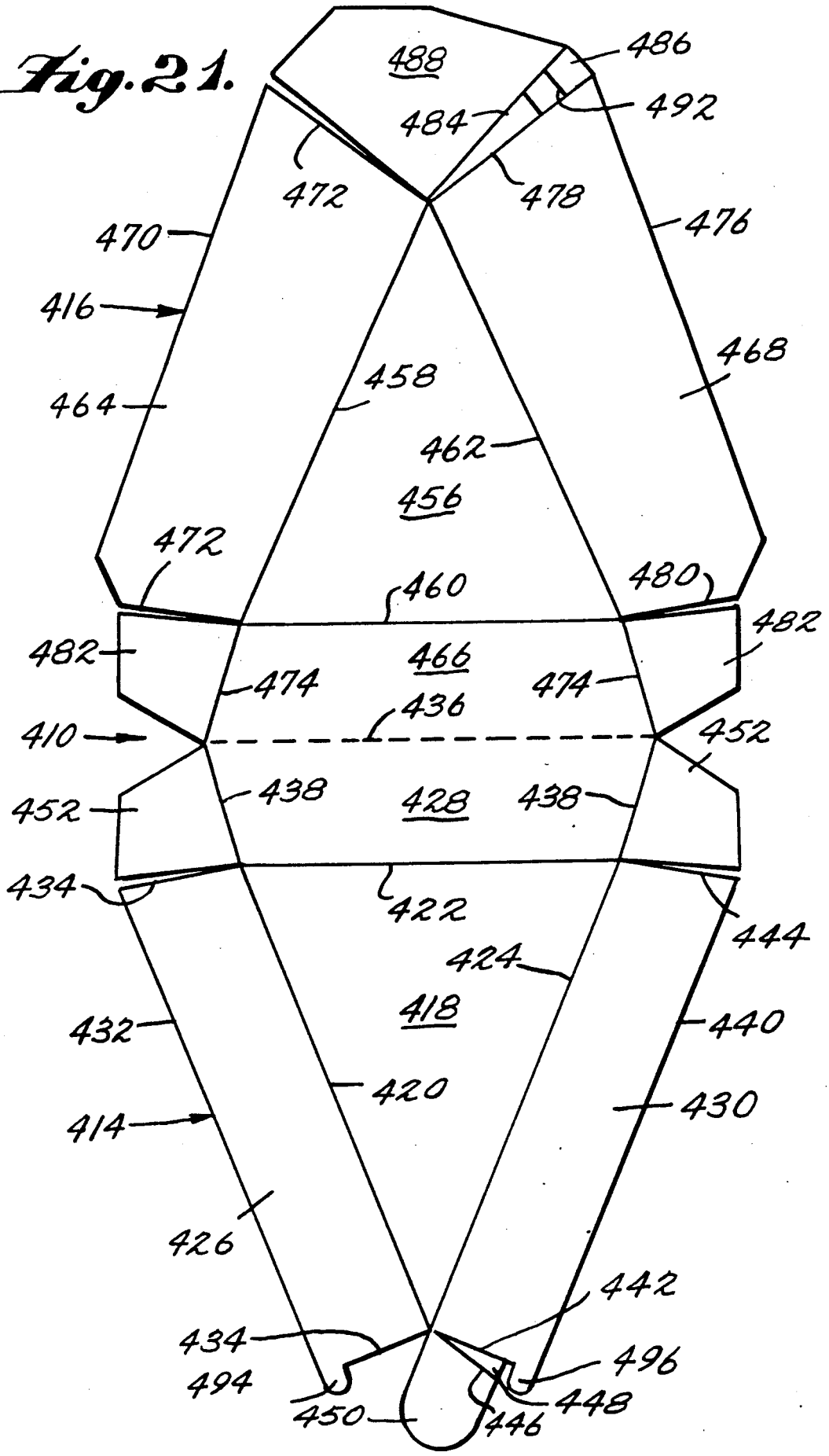
Figure 25:
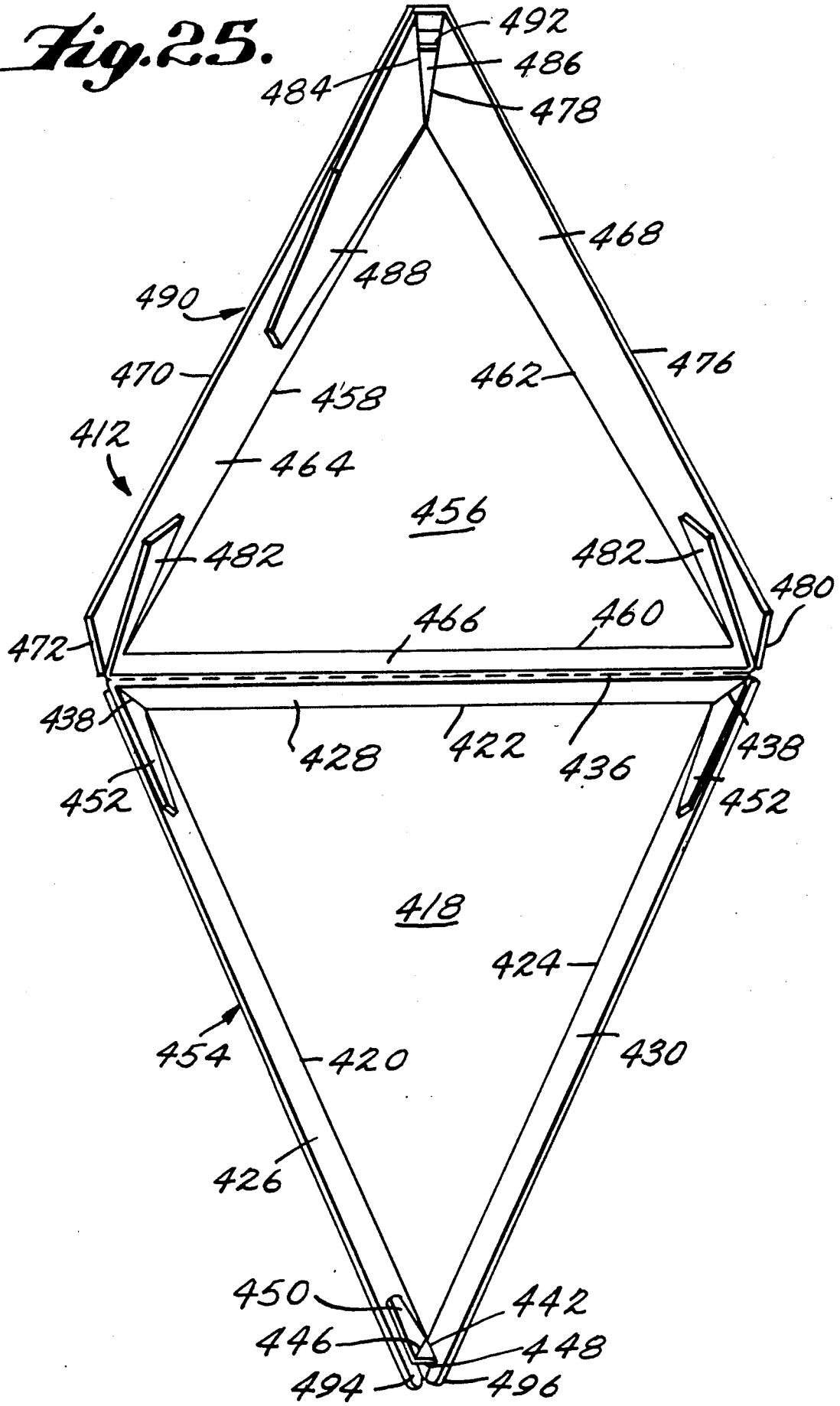
Figure 26:
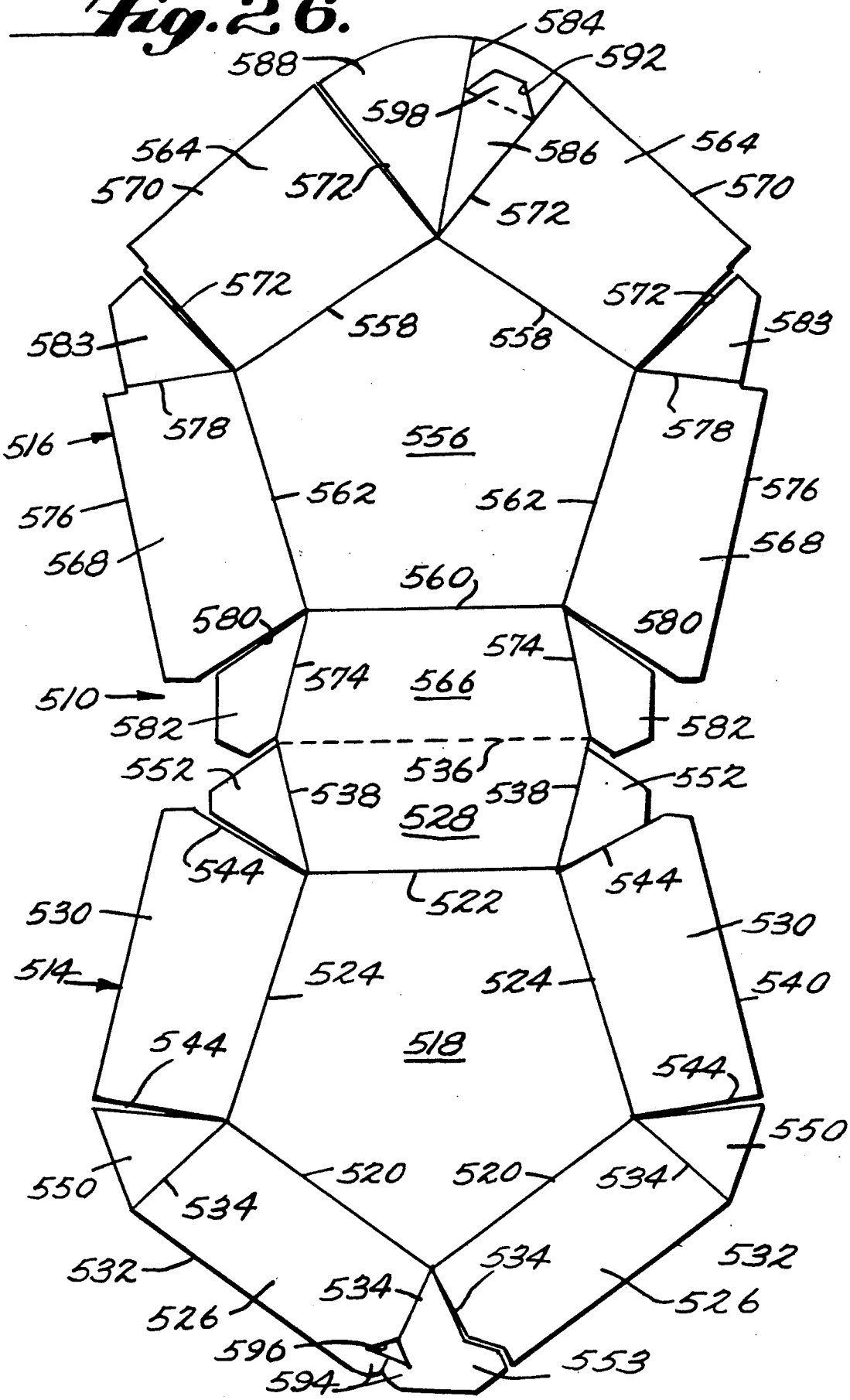

FIGS. 13, 14, and 15 are views similar to FIGS. 8, 9, and 10 of the cover and tray structures erected from the blanks shown in FIGS. 11 and 12;

FIGS. 16 and 17 are views similar to FIGS. 6 and 7 of still another embodiment of the invention;

FIGS. 18, 19, and 20 are views similar to FIGS. 8, 9, and 10 of the tray and cover structures erected from the blank shown in FIGS. 16 and 17;

FIG. 21 is a view similar to FIG. 1 showing a flat blank, of varying form embodying the principles of the present invention erectable into a carton having a three-sided bottom tray structure and a pivoted three-sided cover structure;

FIG. 22 is a front elevational view of the carton in a closed position erected from the blank shown in FIG. 21;

FIG. 23 is a rear elevational view of the carton shown in FIG. 22;

FIG. 24 is a side elevational view of the carton shown in FIG. 22;

FIG. 25 is a top plan view of the carton shown in FIG. 22, showing the same in an open position suitable for entering into a nested stack of similar cartons;

FIG. 26 is a view similar to FIG. 1 showing a flat blank of another form embodying the principles of the present invention erectable into a carton having a five-sided bottom tray structure and a five-sided cover structure;

FIG. 27 is a top plan view of the five-sided cover structure erected from the flat blank shown in FIG. 26 illustrating the same in closed relation with respect to the five-sided bottom tray structure erectable from the blank of FIG. 26;

FIG. 28 is a front elevational view of the carton shown in FIG. 27;

FIG. 29 is a side elevational view of the carton shown in FIG. 27;

FIG. 30 is a rear elevational view of the carton shown in FIG. 27; and

Figure 31:
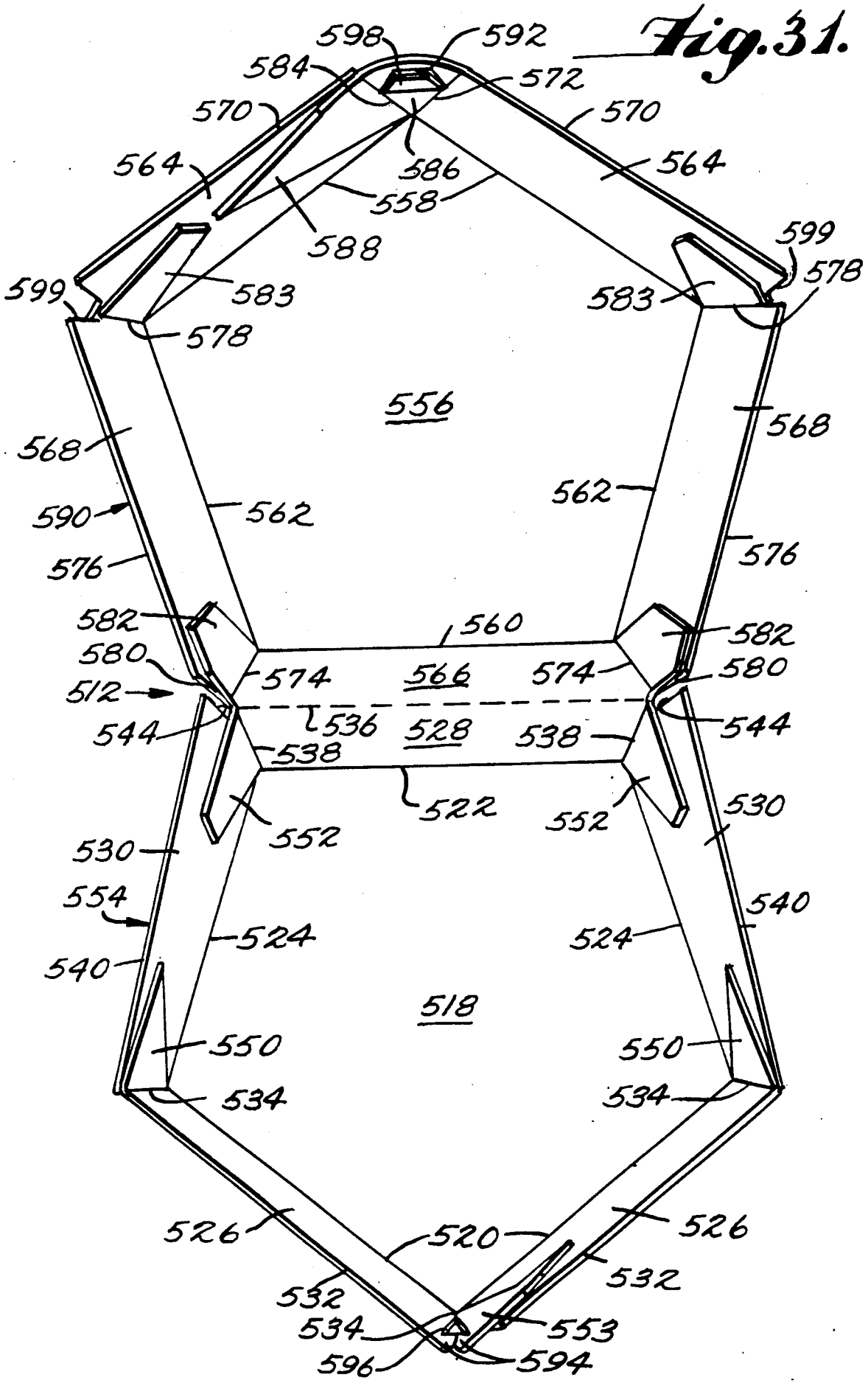

FIG. 31 is a top plan view showing the five-sided cover structure and five-sided bottom tray structure in an open position suitable for enabling the same to be included within a nested stack of similar cartons.

Referring now more particularly to the drawings, there is shown in FIG. 1 thereof one form of a one-piece flat blank of carton material, generally indicated at 10, embodying the principles of the present invention, which is operable to be erected and retained by adhesive into an easy close—easy open carton, generally indicated at 12, shown in FIGS. 2-5, which also embodies the principles of the present invention. The flat blank 10, as shown in FIG. 1, includes a tray section, generally indicated at 14, and a cover section, generally indicated at 16, the two sections being hingedly connected together.

The tray section 14 includes a bottom wall 18 which is defined peripherally by a plurality of straight edges, including a front edge 20, a rearward edge 22, and left and right edges 24. The tray section 14 also includes a plurality of side walls which are hinged to the bottom wall along the straight edges thereof including a front side wall 26, rearward side wall 28, and left and right side walls 30. As shown, the front side wall 26 is defined peripherally by an inner side edge which is common with the front edge 20 of the bottom wall 18, an outer side edge 32 which is a free edge and opposite end edges 34. Rearward side wall 28 is defined peripherally by an inner side edge which is common with the rearward edge 22 of the bottom wall 18, an outer side edge 36 and opposite end edges 38. Left and right side walls 30 are defined peripherally by inner side edges which are common with the left and right edges 24 of the bottom wall 18, outer side edges 40, forward end edges 42 and rearward end edges 44.

Figure 5:
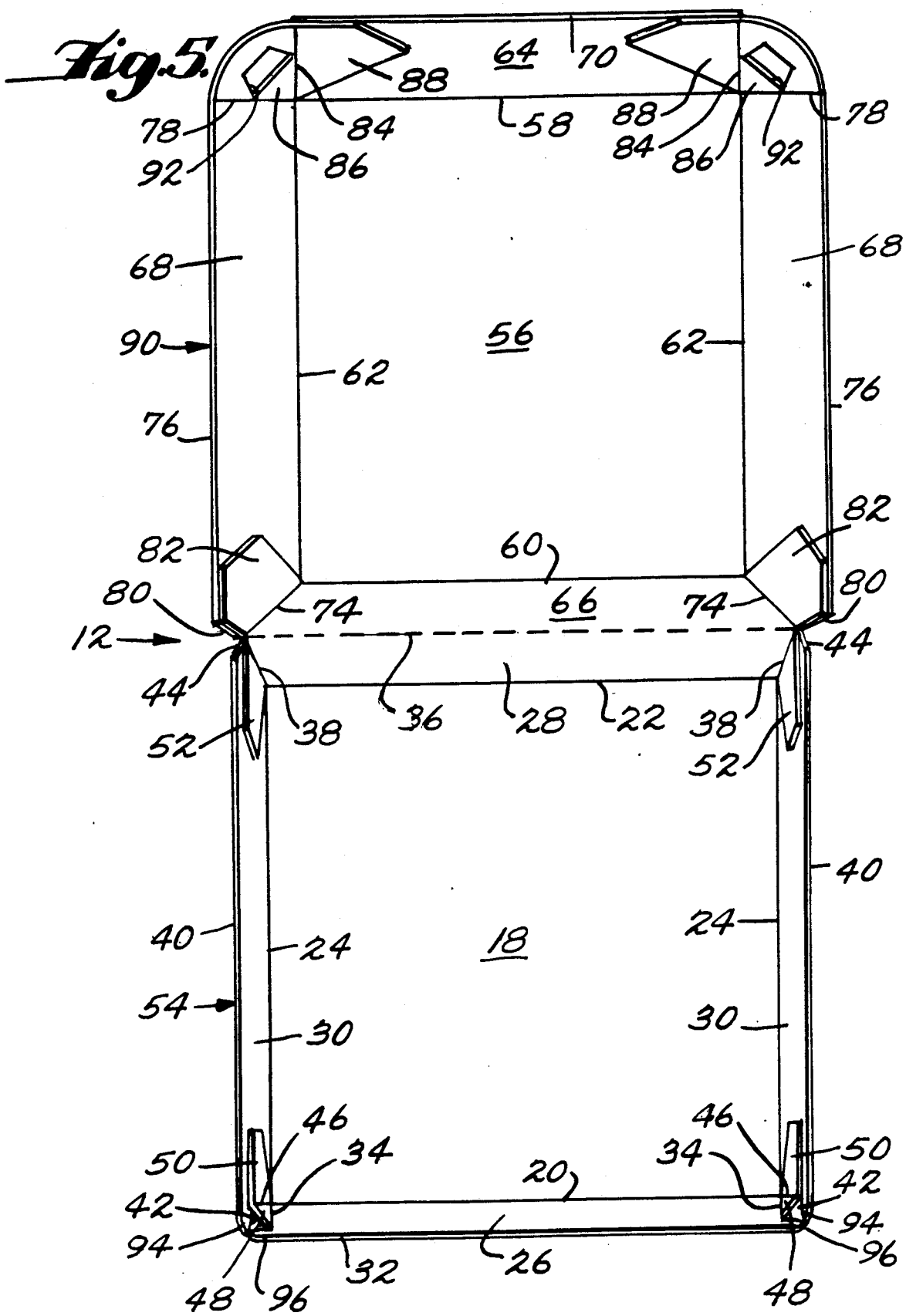
FIG. 5 is a top plan view of the erected carton shown in an open position suitable to be included in a nested stack of similar cartons.

As shown, the opposite end edges 34 of the front side wall 26 define fold lines for integral flaps divided by diagonal fold lines 46 so as to form inner corner walls 48 and outer glue tabs 50. A second pair of flaps providing glue tabs 52 are hinged to the end edges 38 of the rear side wall 28. The four glue tabs provide means for maintaining the tray section 14 in an erected position wherein the side walls 26, 28 and 30 extend upwardly and outwardly from the bottom wall 18 so that the outer edges 32, 36 and 40 of the side walls define an open top of a tray structure, generally indicated at 54. As best shown in FIG. 5, the glue tabs 50 and 52 are suitably glued by a suitable adhesive or glue to the adjacent interior surface of the left and right side walls 30.

The cover section 16 includes a top wall 56 which is of similar configuration to the bottom wall 18, being defined peripherally by front, rearward and left and right corresponding straight edges 58, 60, and 62 respectively. In a similar manner, the cover section includes front, rearward and left and right side walls 64, 66, and 68, respectively, which are hinged to the top wall 56 along the straight edges 58, 60, and 62 respectively thereof. As before, the front side wall 64 is defined peripherally by an inner side edge defined by the front edge 58 of the top wall 56, an outer side edge 70 and a pair of opposite end edges 72 extending therebetween. The rearward side wall 66 is defined peripherally by an inner side edge common with the rear edge 60 of the top wall 56, an outer side edge common with the outer side edge 36 of the rear side wall 28 of the tray section 14 and opposite end edges 74. The left and right side walls 68 are defined peripherally by inner side edges common with the left and right edges 62 of the top wall 56, outer side edges 76, front end edges 78, and rearward end edges 80.

As shown, the end edges 74 of the rearward cover side wall 66 define fold lines for flaps providing glue tabs 82 which are hinged thereto along the fold lines. The front end edges 78 of the left and right side walls 68 are defined by straight fold lines which serve to join integral flaps having diagonal fold lines 84 therein which serve to divide the flaps into inner corner walls 86 and outer glue tabs 88.

As before, the four glue tabs 82 and 88 serve to retain the cover section 16 in an erected condition defining a cover structure, generally indicated at 90. A suitable glue or adhesive is utilized to retain the cover structure 90 in erected condition. As best shown in FIG. 5, the glue tabs 82 are suitably glued to the adjacent interior surfaces of the left and right side walls 68 and the glue tabs 88 are glued to the adjacent interior surface of the front side wall 64.

FIG. 5 also illustrates the erected carton 12 in an open position wherein the bottom wall 18 and top wall 56 are disposed generally in the same plane so that the cover structure 90 is disposed in an open position providing access to the open top of the tray structure 54. It will be noted that, in this position, the tray side walls 26, 28, and 30 extend upwardly and outwardly from the bottom wall 18 and the cover side walls 64, 66, and 68 likewise extend upwardly and outwardly from the top wall 56. The carton 12 is thus in a condition to enter into a nested and stacked relationship with a multiplicity of similar cartons 12 in a similar open position.

Figure 2:
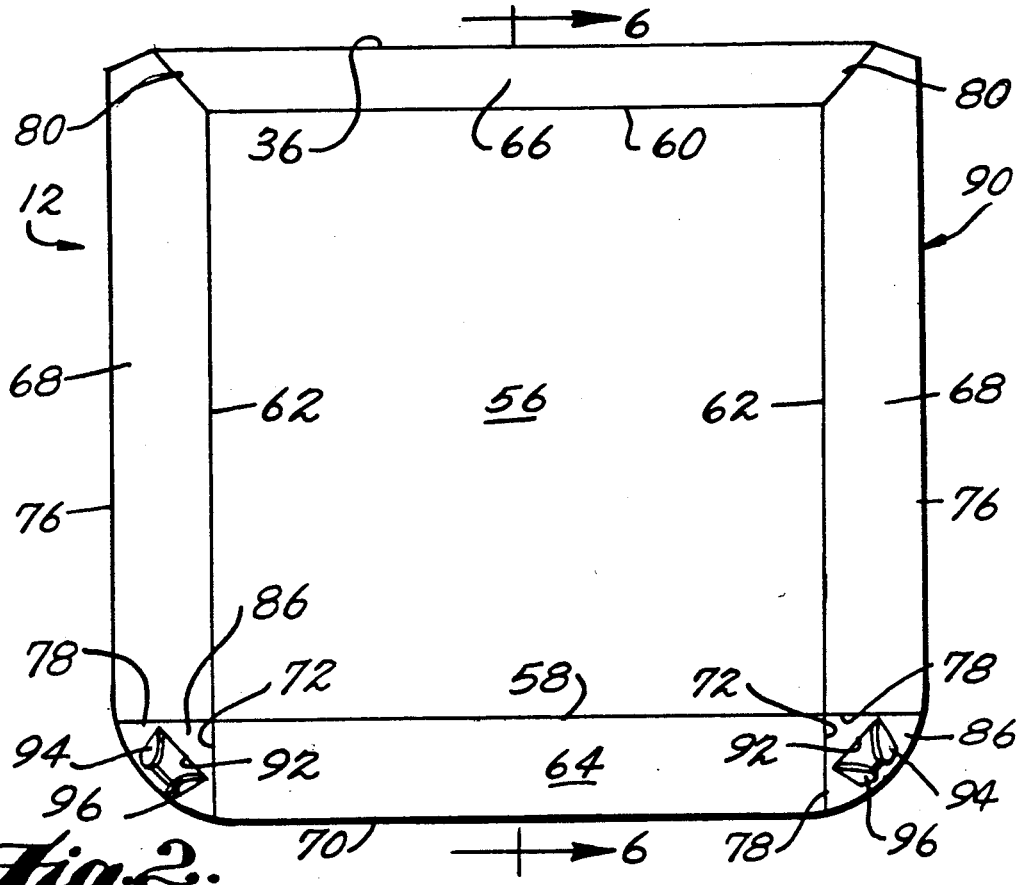
FIG. 2 is a top plan view of the erected carton.
Figure 3:
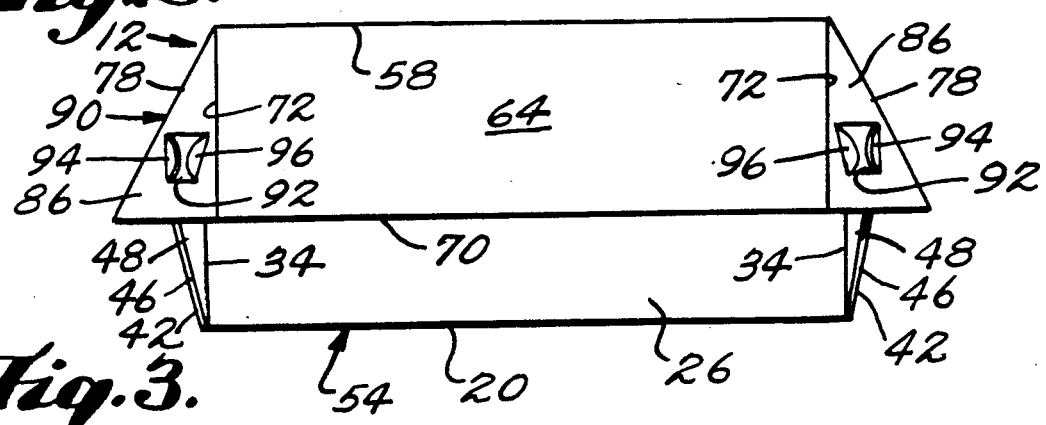
FIG. 3 is a front elevational view of the erected carton.
Figure 4:
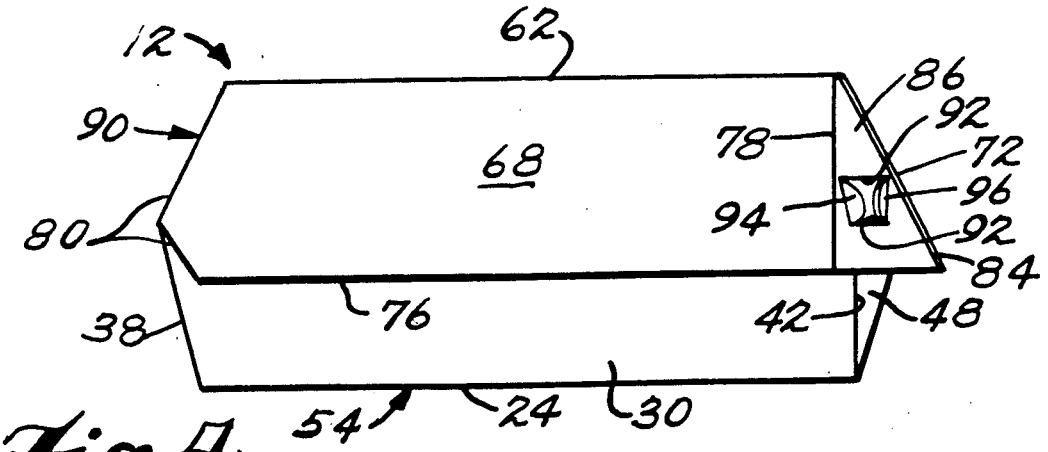
FIG. 4 is a side elevational view of the erected carton.

The common outer side edges 36 of the rear side walls 28 and 66 provide a hinge about which the cover structure 90 can be moved from its open position, as shown in FIG. 5, into a closed position, as shown in FIGS. 2–4, wherein the front side wall 64, corner walls 86, and the left and right side walls 68 of the cover structure 90 extend downwardly and outwardly of the upper edges of the front side wall 26, corner walls 48, and left and right side walls 30 of the bottom tray structure 54.

In accordance with the principles of the present invention, means is provided in the carton blank for releasably locking the cover structure 90 in its closed position with respect to the bottom tray structure 54. This means preferably includes openings 92 formed in the corner walls 86 respectively of the cover structure 90, tabs 94 defined by bulges in the outer portions of the forward end edges 42 of the left and right tray side walls 30 and tabs 96 defined by bulges in the outer portions of the opposite end edges 34 of the front side wall 26 outwardly of the inner fold lines defined thereby.

To close the carton after the tray structure has been filled with a suitable product, as, for example, fast food, such as a hamburger or the like, the cover structure 90 is simply hinged about the hinge line defined by the edge 36 until it reaches a position generally overlying the tray structure 54. In this position, it will be noted that the front side wall 64, the left and right side walls 68 and the corner walls 86 of the cover structure 90 extend downwardly and outwardly beyond the open top of the tray structure 54. It will also be noted that the corner walls 86 include interior surfaces disposed below the openings 92 which are in a position to be engaged by the tabs 94 and 96 as the cover structure 90 is pressed downwardly after the aforesaid interengagement. As the cover structure 90 is continued to be moved downwardly, either the lower portion of the corner walls deflect outwardly or the tabs 94 and 96 deflect inwardly or both after which the tabs reach a position in which they snap through the openings 92 so as to extend upwardly and outwardly through the openings. This snap action extension of the tabs 94 and 96 into the openings 92 serves to releasably lock the cover structure 90 in the closed position shown in FIG. 2, 3, and 4 with respect to the tray structure 54.

The cover structure 90 is moved from its closed position into its open position by lifting up on the front side wall 64 or outwardly at each corner wall 86 along the lower portion thereof. This movement causes the tabs 94 and 96 to be cammed inwardly and/or the lower portion of the corner walls 86 to be cammed outwardly as the cover structure is moved upwardly, thus releasing the locking action and permitting the cover structure 90 to be moved into a fully open position to provide access to the fast food supported on the bottom wall 18 within the tray structure 54.

In the embodiment shown, the corner walls are of triangular configuration with two sides extending from the corner of the adjacent side edges of the top wall 56. The corner walls thus are disposed in a plane which is related angularly with respect to the angularly related planes of the front side wall 64 and left and right side walls 68. It will be understood that glue tabs 52 and 82, while shown integrally hinged to rear walls 28 and 66 could just as easily be hinged to end edges 44 and 80 of the left and right side walls 30 and 68. Similarly, the glue tabs 50 could be integral with the left and right side walls 30 rather than the front wall 26. With respect to the corner walls 86, while these are shown to be triangular in configuration, they could be four-sided with one side integrally hinged to a diagonal corner of the top wall or they could be hinged from the end edges 42 of the front wall. It will also be understood that, while the openings 92 are each of trapezoidal configuration, they may assume other configurations which would cooperate with tabs of changed configuration.

Referring now more particularly to FIGS. 6–10 of the drawings, there is shown therein another variation within the principles of the present invention wherein a carton, generally indicated at 112, shown in FIGS. 8–10, is erectable from two flat blanks including a tray blank, generally indicated at 114, and a cover blank, generally indicated at 116.

The tray blank 114 includes a bottom wall 118 which is defined peripherally by a plurality of straight edges, including a front edge 120, a rearward edge 122, and left and right edges 124. The tray blank 114 also includes a plurality of side walls which are hinged to the bottom wall along the straight edges thereof including a front side wall 126, rearward side wall 128, and left and right side walls 130. As shown, the front side wall 126 is defined peripherally by an inner side edge which is common with the front edge 120 of the bottom wall 118, an outer side edge 132 which is a free edge and opposite end edges 134. Rearward side wall 128 is defined peripherally by an inner side edge which is common with the rearward edge 122 of the bottom wall 118, an outer side edge 136 and opposite end edges 138. Left and right side walls 130 are defined peripherally by inner side edges which are common with the left and right edges 124 of the bottom wall 118, outer side edges 140, forward end edges 142 and rearward end edges 144.

As best shown in FIG. 6, the forward end edges 142 of the left and right walls 130 have hinged thereto a flap providing a combined corner wall and glue flap 150. In addition, the rearward end edges 144 of the left and right walls 130 have integral flaps providing similar combined corner wall and glue tabs 152 hinged thereto. The four glue tabs provide means for maintaining the tray blank 114 in an erected position wherein the side walls 126, 128 and 130 extend upwardly and outwardly from the bottom wall 118 so that the outer edges 132, 136 and 140 of the side walls define an open top of a tray structure, generally indicated at 154. As best shown in FIG. 9, outer portions of the glue tabs 150 and 152 are suitably glued by a suitable adhesive or glue to the adjacent interior surface of the front and rearward side walls 126 and 128 respectively so that inner portions define corner walls for the associated front and rear side walls.

The cover blank 116 includes a top wall 156 which is of similar configuration to the bottom wall 118, being defined peripherally by front, rearward and left and right corresponding straight edges 158, 160, and 162 respectively. In a similar manner, the cover blank 116 includes front, rearward and left and right side walls 164, 166, and 168, respectively, which are hinged to the top wall 156 along the straight edges 158, 160, and 162 respectively thereof. As before, the front side wall 164 is defined peripherally by an inner side edge defined by the front edge 158 of the top wall 156, an outer side edge 170 and a pair of opposite end edges 172 extending therebetween. The rear side wall 166 is defined peripherally by an inner side edge common with the rear edge 160 of the top wall 156, an outer side edge 170 and opposite end edges 174. The left and right side walls 168 are defined peripherally by inner side edges common with the left and right edges 162 of the top wall 156, outer side edges 176, front end edges 178, and rearward end edges 180.

As shown, the front end edges 178 and rearward end edges 180 of the left and right side walls 168 are defined by straight fold lines which serve to join integral flaps having diagonal fold lines 184 therein which serve to divide the flaps into inner corner walls 186 and outer glue tabs 188.

The four glue tabs 188 serve to retain the cover blank 116 in an erected condition defining a cover structure, generally indicated at 190. As before, a suitable glue or adhesive is utilized to retain the cover structure 90 in erected condition. As best shown in FIGS. 8 and 10, the glue tabs 188 are suitably glued to the adjacent interior surfaces of the front and rearward cover walls 164 and 166.

The two separate tray and cover structures can be disposed in an open position wherein the bottom wall 118 and top wall 156 are disposed generally in the same plane so that the cover structure 190 is disposed in an open position providing access to the open top of the tray structure 154. In this position, which is similar to the position of the carton 12 shown in FIG. 5, the tray side walls 126, 128, and 130 extend upwardly and outwardly from the bottom wall 118 and the cover side walls 164, 166, and 168 likewise extend upwardly and outwardly from the top wall 156. Each structure 154 and 190 is thus in a condition to enter into a nested and stacked relationship with a multiplicity of similar structures 154 and 190 in a similar open position.

It is greatly preferred that bottom and top walls are defined peripherally by straight edges which are of equal length. This relationship insures that the cover structure 190 can close the tray structure 154 in any one of a number of different positions, the number thereof being equal to the number of side edges. Thus, with the square configuration shown, the cover structure 190 can close the tray structure in any one of four orientations. In other words, the two structures are essentially symmetrical with respect to each other in any one of four different positions. While this symmetrical relationship is preferred, the two structures could be non-symmetrical in which case closure would occur only in one position of orientation.

In accordance with the principles of the present invention, means is provided in the carton blanks 114 and 116 for releasably locking the cover structure 190 in its closed position with respect to the bottom tray structure 154. This means preferably includes openings 192 formed in the corner walls 186 of the cover structure 190 and interconnected tabs 194 defined by openings 196 in the blank 116 at the outer portions of the forward end edges 142 and the rearward end edges 144 of the left and right tray side walls 130.

To close the carton after the tray structure 154 has been filled with a suitable product, as, for example, fast food, such as a hamburger or the like, the cover structure 190 is simply inverted and moved downwardly toward the tray structure 154 until it reaches a position generally overlying the tray structure 154. Here again, it will be noted that the front side wall 164, the left and right side walls 168 and the corner walls 186 of the cover structure 190 extend downwardly and outwardly beyond the open top of the tray structure 154. It will also be noted that the corner walls 186 include interior surfaces disposed below the openings 192 which are in a position to be engaged by the interconnected tabs 194 as the cover structure 190 is pressed downwardly after the aforesaid interengagement. As the cover structure 190 is continued to be moved downwardly, either the lower portion of the corner walls 180 deflect outwardly or the interconnected tabs 1946 deflect inwardly or both after which the tabs reach a position in which they snap through the openings 192 so as to extend upwardly and outwardly through the openings. This snap action extension of the interconnected tabs 194 into the openings 192 serves to releasably lock the cover structure 190 in the closed position shown in FIG. 10 with respect to the tray structure 154.

The cover structure 190 is moved from its closed position into its open position by lifting up on any of the side walls 164, 166, and 168 or outwardly at any corner wall 186 along the lower portion thereof. This movement causes the interconnected tabs 194 to be cammed inwardly and/or the lower portion of the corner wall 186 to be canned outwardly as the cover structure 190 is moved upwardly, thus releasing the locking action and permitting the cover structure 190 to be moved into a fully open position to provide access to the fast food supported on the bottom wall 118 within the tray structure 154.

Referring now more particularly to FIGS. 11–15, there is shown therein a two-piece carton 212 which is erected from a tray blank 214 and a separate cover blank 216. The cover blank 216 includes the basic components of the cover blank 116 including a bottom wall 218, side walls 226, 228, and 230, defined by edges which are given numerals corresponding to the numerals of FIG. 6, except that the first digit "1" is changed to "2". The tray blank 214 differs from the tray blank 114 in that instead of having flaps providing combined corner wall and glue tabs 150 and 152 hinged to the end edges 142 and 144 of the left and right side walls 130, the tray blank 214 has flaps which provide simple glue tabs 250 hinged to the front end edges 242 of the left and right side walls 230 and simple glue tabs 252 hinged to the rear end edges 244 of the left and right side walls 230. It will be noted that the front end edges 234 and rear end edges 238 are changed in shape to accommodate the simple glue tabs 250 and 252. In erecting the tray blank 214 into a tray structure 254, the glue tabs 250 are suitably glued to the interior surfaces of the front side wall 226 and the glue tabs 252 are suitably glued to the interior surfaces of the rear side wall 228.

The cover blank 216 is constructed similarly to the cover blank 116 and corresponding parts are designated by corresponding numerals except that the first digit is changed from "1" to "2". The only structural difference between the cover blank 216 and the cover blank 116 exists in the shape of the openings 292 formed in the corner walls 286. As shown, the openings 292 are more in a triangular configuration than the trapezoidal configuration of the openings 192. The manner in which the cover blank 216 is erected into a cover structure 290 is similar to the manner in which the cover blank 116 is erected into a cover structure 190. Similarly, the tray structure 254 and the cover structure 290 are disposable in open relation with respect to one another and are moved into closing relation in a similar manner to the tray structure 154 and cover structure 190. In this regard, it will be noted that the outer corners of the end edges of all of the side walls define tabs 294 which are rounded as indicated at 296 so that in the erected tray structure 254, the tabs 294 are rounded at each end of each side wall. This rounded configuration enables the corners to engage the portion of the corner walls 286 below the openings 292 during the closing operation and snap into the openings 292 when the cover structure is finally moved into closed position.

Referring now more particularly to FIGS. 16–20, there is shown therein a two-piece carton 312 which is erected from a tray blank 314 and a separate cover blank 316. The cover blank 316, like the cover blank 216, includes the basic components of the cover blank 116 including a bottom wall 318, side walls 326, 328, and 330, defined by edges which are given numerals corresponding to the numerals of FIG. 6, except that the first digit "1" is changed to "3". The tray blank 314 differs from the tray blank 114 in that instead of having flaps providing combined corner wall and glue tabs 150 and 152 hinged to the end edges 142 and 144 of the left and right side walls 130, the tray blank 314 has flaps similar to the flaps of the tray blank section 14 which are divided by fold lines 346 to provide inner corner walls 348 hinged to the front end edges 342 of the left and right side walls 330 and outer glue tabs 350 hinged to the rear end edges 344 of the left and righthand side walls 330. It will be noted, however, that corner walls 348 are of lens like configuration defined by opposite symmetrically arranged convexly curved corner lines or edges. It will be noted that the front end edges 334 and rear end edges 338 are changed to include the aforesaid arcuate shape. In erecting the tray blank 314 into a tray structure 354, the glue tabs 350 are suitably glued to the interior surfaces of the front side wall 326 and rear side wall 328. This securement enables the corner walls 348 to assume a position within an arcuate plane intermediate the flat planes of the associated side walls.

The cover blank 316, like the cover blank 216, is constructed similarly to the cover blank 116 and corresponding parts are designated by corresponding numerals except that the first digit is changed from "1" to "3". The only structural difference between the cover blank 316 and the cover blank 116 exists in the shape of the openings 392 formed in the corner walls 386. As shown, the openings 392 are trapezoidal in shape intermediate the triangular configuration of the openings 292 and the trapezoidal configuration of the openings 192. The manner in which the cover blank 316 is erected into a cover structure 390 is similar to the manner in which the cover blank 116 is erected into a cover structure 190. Similarly, the tray structure 354 and the cover structure 390 are disposable in open relation with respect to one another and are moved into closing relation in a similar manner to the tray structure 154 and cover structure 190. As with the cover structure 290, it will be noted that the outer corners of the end edges of all of the side walls define tabs 394 which are rounded as indicated at 396 so that in the erected tray structure 354, the tabs 394 are rounded at each end of each side wall. This rounded configuration enables the tabs 394 to engage the portion of the corner walls 386 below the openings 392 during the closing operation and snap into the openings 392 when the cover structure 390 is finally moved into closed position.

The different constructions relating to the corners of the tray structure 154, 254, and 354 lend different stiffnesses to the corners resulting in the tray structure 354 having the most corner stiffness and the tray structure 154 the least corner stiffness. This difference in corner stiffness results in a greater amount of flexure being taken up in the corner walls of the cover structures during opening and closing.

Referring now more particularly to FIG. 21 of the drawings, there is shown therein another form of a one-piece flat blank of carton material, generally indicated at 410, embodying the principles of the present invention, which is operable to be erected and retained by adhesive into an easy close—easy open carton, generally indicated at 412, shown in FIGS. 22–25, which also embodies the principles of the present invention. The flat blank 410, like the flat one-piece blank 10, includes a tray section, generally indicated at 414, and a cover section, generally indicated at 416, the two sections being hingedly connected together.

The tray section 414 includes a bottom wall 418 which is defined peripherally by a plurality of straight edges, including a left front edge 420, a rearward edge 422, and a right front edge 424. The tray section 414 also includes a plurality of side walls which are hinged to the bottom wall along the straight edges thereof including a left front side wall 426, rearward side wall 428, and right front side wall 430. As shown, the left front side wall 426 is defined peripherally by an inner side edge which is common with the left front edge 420 of the bottom wall 418, an outer side edge 432 which is a free edge and opposite end edges 434, which also are free edges. Rearward side wall 428 is defined peripherally by an inner side edge which is common with the rearward edge 422 of the bottom wall 418, an outer side edge 436 and opposite end edges 438. Right front side wall 430 is defined peripherally by an inner side edge which is common with the right front edge 424 of the bottom wall 418, an outer side edge 440, a forward end edge 442 and a rearward end edge 444.

As shown, the forward end edges 442 of the right front side wall 430 defines a fold line for an integral flap divided by a diagonal fold line 446 so as to form a front corner wall 448 and an outer glue tab 450. A second pair of flaps providing glue tabs 452 are hinged to the end edges 438 of the rear side wall 428. The three glue tabs provide means for maintaining the tray section 414 in an erected position wherein the side walls 426, 428 and 430 extend upwardly and outwardly from the bottom wall 418 so that the outer edges 432, 436 and 440 of the side walls define an open top of a tray structure, generally indicated at 454. As best shown in FIG. 25, the glue tabs 452 are suitably glued by a suitable adhesive or glue to the adjacent interior surfaces of the left and right front side walls 426 and 430. The glue tab 450 is adhered to the adjacent inside surface of the left front side wall 426.

The cover section 416 includes a top wall 456 which is of similar configuration to the bottom wall 418, being defined peripherally by left front, rearward and right front corresponding straight edges 458, 460, and 462 respectively. In a similar manner, the cover section includes left front, rearward and right front side walls 464, 466, and 468, respectively, which are hinged to the top wall 456 along the straight edges 458, 460, and 462 respectively thereof. As before, the left front side wall 464 is defined peripherally by an inner side edge defined by the left front edge 458 of the top wall 456, an outer side edge 470 and a pair of opposite end edges 472 extending therebetween. The rearward side wall 466 is defined peripherally by an inner side edge common with the rearward edge 460 of the top wall 456, an outer side edge common with the outer side edge 436 of the rear side wall 428 of the tray section 414 and opposite end edges 474. The right front side wall 468 is defined peripherally by an inner side edge common with the right front edge 462 of the top wall 456, an outer side edge 476, a front end edge 478, and a rearward end edge 480.

As shown, the end edges 474 of the rearward cover side wall 466 define fold lines for flaps providing glue tabs 482 which are hinged thereto along the fold lines. The front end edge 478 of the right front side wall 468 is defined by a straight fold line which serves to join an integral flap having a diagonal fold line 484 therein which serves to divide the flap into an inner front corner wall 486 and outer glue tab 488.

As before, the three glue tabs 482 and 488 serve to retain the cover section 416 in an erected condition defining a cover structure, generally indicated at 490. A suitable glue or adhesive is utilized to retain the cover structure 490 in erected condition. As best shown in FIG. 25, the glue tabs 482 are suitably glued to the adjacent interior surfaces of the left and right front side walls 464 and 468 and the glue tab 488 is glued to the adjacent interior surface of the left front side wall 464.

FIG. 25 also illustrates the erected carton 12 in an open position wherein the bottom wall 418 and top wall 456 are disposed generally in the same plane so that the cover structure 490 is disposed in an open position providing access to the open top of the tray structure 454. It will be noted that, in this position, the tray side walls 426, 428, and 430 extend upwardly and outwardly from the bottom wall 418 and the cover side walls 464, 466, and 468 likewise extend upwardly and outwardly from the top wall 456. The carton 412 is thus in a condition to enter into a nested and stacked relationship with a multiplicity of similar cartons 412 in a similar open position.

The common outer side edges 436 of the rear side walls 428 and 466 provide a hinge about which the cover structure 490 can be moved from its open position, as shown in FIG. 25, into a closed position, as shown in FIGS. 22–24, wherein the left front side wall 464, front corner wall 486, and the right front side wall 468 of the cover structure 490 extend downwardly and outwardly of the upper edges of the left front side wall 426, corner wall 448, and right front side walls 430 of the bottom tray structure 454.

In a manner similar to the carton blank 10, means is provided in the carton blank 410 for releasably locking the cover structure 490 in its closed position with respect to the bottom tray structure 454. This means preferably includes an opening 492 formed in the front corner wall 486 of the cover structure 490, a tab 494 defined by a bulge in the outer portion of the forward end edge 434 of the left front tray side wall 426 and a tab 496 defined by a bulge in the outer portion of the forward end edge 442 of the right front side wall 430 outwardly of the inner fold line defined thereby.

To close the carton after the tray structure has been filled with a suitable product, as, for example, fast food, such as a pie wedge or the like, the cover structure 490 is simply hinged about the hinge line defined by the edge 436 until it reaches a position generally overlying the tray structure 454. In this position, it will be noted that the left front side wall 464, the right front side wall 468 and the corner wall 486 of the cover structure 490 extend downwardly and outwardly beyond the open top of the tray structure 454. It will also be noted that the corner wall 486 includes an interior surface disposed below the opening 492 which is in a position to be engaged by the tabs 494 and 496 as the cover structure 490 is pressed downwardly after the aforesaid interengagement. As the cover structure 490 is continued to be moved downwardly, either the lower portion of the corner wall 486 deflects outwardly or the tabs 494 and 496 deflect inwardly or both after which the tabs reach a position in which they snap through the opening 492 so as to extend upwardly and outwardly through the opening. This snap action extension of the tabs 494 and 496 into the opening 492 serves to releasably lock the cover structure 490 in the closed position shown in FIG. 22, 23, and 24 with respect to the tray structure 454. Since the corner wall 486 is smaller and therefore less flexible than the corner walls 86, a greater amount of flexure will occur in the tabs 494 and 496 than is the case with tabs 94 and 96 before the snap action takes place. Moreover, the configuration is such that the snap action may be augmented by more flexure at the hinge 436 than is the case with hinge 236.

The cover structure 490 is moved from its closed position into its open position by lifting up at the corner wall 486 along the lower portion thereof. This movement causes the tabs 494 and 496 to be cammed inwardly and/or the lower portion of the corner wall 486 to be cammed outwardly as the cover structure is moved upwardly, thus releasing the locking action and permitting the cover structure 490 to be moved into a fully open position to provide access to the fast food supported on the bottom wall 418 within the tray structure 454.

Referring now more particularly to FIG. 26 of the drawings, there is shown therein still another form of a one-piece flat blank of carton material, generally indicated at 510, embodying the principles of the present invention, which is operable to be erected and retained by adhesive into an easy close—easy open carton, generally indicated at 512, shown in FIGS. 27–31, which also embodies the principles of the present invention. The flat blank 510, like the blank 10, includes a tray section, generally indicated at 514, and a cover section, generally indicated at 516, the two sections being hingedly connected together.

The tray section 514 includes a bottom wall 518 which is defined peripherally by a plurality of straight edges, including left and right front edges 520, a rearward edge 522, and left and right rear edges 524. The tray section 514 also includes a plurality of side walls which are hinged to the bottom wall along the straight edges thereof including left and right front side walls 526, rearward side wall 528, and left and right rear side walls 530. As shown, the left and right front side walls 526 are defined peripherally by inner side edges which are common with the left and right front edges 520 of the bottom wall 518, outer side edges 532 which are free edges and opposite end edges 534. Rearward side wall 528 is defined peripherally by an inner side edge which is common with the rearward edge 522 of the bottom wall 518, an outer side edge 536 and opposite end edges 538. Left and right rear side walls 530 are defined peripherally by inner side edges which are common with the left and right rear edges 524 of the bottom wall 518, outer side edges 540, which are free edges and opposite end edges 544, which also are free edges.

As shown, the rearward opposite end edges 534 of the left and right front side walls 526 define fold lines for a first pair of flaps providing glue tabs 550. A second pair of flaps providing glue tabs 552 are hinged to the end edges 538 of the rear side wall 528. As shown, the forward end edge 534 of the left front side wall 526 defines a fold line for a flap providing a fifth glue tab 553 and the forward end edge 534 of the right front side wall 526 is defined by a cut which defines the adjacent edge of the glue tab 553. The five glue tabs provide means for maintaining the tray section 514 in an erected position wherein the side walls 526, 528 and 530 extend upwardly and outwardly from the bottom wall 518 so that the outer edges 532, 536 and 540 of the side walls define an open top of a tray structure, generally indicated at 554. As best shown in FIG. 31, the glue tabs 550 and 552 are suitably glued by a suitable adhesive or glue to the adjacent interior surfaces of the left and right rear side walls 530. Glue tab 553 is glued to the adjacent interior surface of the left front side wall 526.

The cover section 516 includes a top wall 556 which is of similar configuration to the bottom wall 518, being defined peripherally by left and right front edges 558, rearward edge 556, and left and right rear edges 562. In a similar manner, the cover section includes left and right front side walls 564, rearward side wall 566, and left and right rear side walls 568, respectively, which are hinged to the top wall 556 along the straight edges 558, 560, and 562 respectively thereof. As before, the left and right front side walls 564 are defined peripherally by inner side edges common with the left and right front edges 558 of the top walls 556, outer side edges 570 and opposite end edges 572 extending therebetween. The rearward side wall 566 is defined peripherally by an inner side edge common with the rear edge 560 of the top wall 556, an outer side edge common with the outer side edge 536 of the rear side wall 528 of the tray section 514 and opposite end edges 574. The left and right rear side walls 568 are defined peripherally by inner side edges common with the left and right rear edges 562 of the top wall 556, outer side edges 576, front end edges 578, and rearward end edges 580.

As shown, the end edges 574 of the rearward cover side wall 566 define fold lines for flaps providing glue tabs 582 which are hinged thereto along the fold lines. The front end edges 578 of the left and right rear side walls 568 are defined by straight fold lines which serve to join flaps defining glue tabs 583 therewith. The front end edge of the right front side wall 564 is defined by a fold line which serves to join an integral flap having a diagonal fold line 584 therein which serves to divide the flap into a front corner wall 586 and an outer glue tab 588.

As before, the five glue tabs 582, 583, and 588 serve to retain the cover section 516 in an erected condition defining a cover structure, generally indicated at 590. A suitable glue or adhesive is utilized to retain the cover structure 590 in erected condition. As best shown in FIG. 31, the glue tabs 582 are suitably glued to the adjacent interior surfaces of the left and right rear side walls 568, the glue tabs 583 are suitably glued to the adjacent interior surfaces of the left and right front side walls 564, and the glue tab 588 is glued to the adjacent interior surface of the left front side wall 564.

FIG. 31 also illustrates the erected carton 512 in an open position wherein the bottom wall 518 and top wall 556 are disposed generally in the same plane so that the cover structure 590 is disposed in an open position providing access to the open top of the tray structure 554. It will be noted that, in this position, the tray side walls 526, 528, and 530 extend upwardly and outwardly from the bottom wall 518 and the cover side walls 564, 566, and 568 likewise extend upwardly and outwardly from the top wall 556. The carton 512 is thus in a condition to enter into a nested and stacked relationship with a multiplicity of similar cartons 512 in a similar open position.

The common outer side edges 536 of the rearward side walls 528 and 566 provide a hinge about which the cover structure 590 can be moved from its open position, as shown in FIG. 31, into a closed position, as shown in FIGS. 27–30, wherein the left and right front side walls 564, front corner wall 586, and the left and right rear side walls 568 of the cover structure 590 extend downwardly and outwardly of the upper edges of the left and right front side walls 526 and left and right rear side walls 530 of the bottom tray structure 554.

As with the other embodiments of the present invention, means is provided in the carton blank 510 for releasably locking the cover structure 590 in its closed position with respect to the bottom tray structure 554. This means preferably includes an opening 592 formed in the front corner wall 586 of the cover structure 590 and joined tabs 594 defined by an opening 596 in the outer portion of the left front side wall 526 and glue tabs 553 along the associated end edge 534. The blank 510 illustrates a variation which can be utilized in any of the other blanks previously described. The variation relates to the manner of providing the opening 592 in the corner wall 586. Instead of providing the opening by cutting out and removing carton material, the opening is provided by a U-shaped cut and a fold line extending between the ends of the U-shaped cut which leaves a flap 598. The opening is provided by hinging either inwardly (as shown) or outwardly along the fold line flap 598 defined by the U-shaped cut. With the flap 598 thus displaced, the opening 592 is available for the entry of tabs 594 therethrough.

To close the carton after the tray structure 554 has been filled with a suitable product, as, for example, fast food, such as a hamburger or the like, the cover structure 590 is simply hinged about the hinge line defined by the edge 536 until it reaches a position generally overlying the tray structure 554. In this position, it will be noted that the left and right front side walls 564, the left and right rear side walls 568 and the front corner wall 586 of the cover structure 590 extend downwardly and outwardly beyond the open top of the tray structure 554. It will also be noted that the front corner wall 586 includes an interior surface disposed below the opening 592 which is in a position to be engaged by the joined tabs 594 as the cover structure 590 is pressed downwardly after the aforesaid interengagement. As the cover structure 590 is continued to be moved downwardly, either the lower portion of the corner wall 586 deflects outwardly or the joined tabs 594 deflect inwardly or both after which the tabs reach a position in which they snap through the opening 592 so as to extend upwardly and outwardly through the opening. This snap action extension of the joined tabs 594 into the opening 592 serves to releasably lock the cover structure 590 in the closed position shown in FIG. 27–30, with respect to the tray structure 554.

In order to limit the extent to which the rearward portion of the cover structure 590 can be pushed down with respect to the tray structure 554, the outer portions of the rear end edges 572 of the left and right front side walls 564 and of the forward end edges 578 of the left and right rear side walls 568 are relieved so that when the cover structure 590 is erected, there are notches 599 provided at the juncture between the outer edges 570 and 576. As best shown in FIGS. 29 and 30, the corners provided by the juncture between outer edges 532 and 540 of the tray structure 554 enter into the notches 599 and thus limit downward movement of the cover structure 590 when it is moved into its closed position.

The cover structure 590 is moved from its closed position into its open position by lifting up on the front corner wall 586 along the lower portion thereof. This movement causes the tabs 594 to be cammed inwardly and/or the lower portion of the corner walls 586 to be cammed outwardly as the cover structure 590 is moved upwardly, thus releasing the locking action and permitting the cover structures 590 to be moved into a fully open position to provide access to the fast food supported on the bottom wall 518 within the tray structure 554.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A carton erected from carton material in cut and scored blank form, said carton comprising a lower tray structure comprising a bottom wall having a periphery including a plurality of straight edges, tray side walls folded upwardly from the straight edges of said bottom wall, means interconnecting adjacent tray side walls so that upper edges thereof define an open top for said tray structure, a cover structure for covering the open top of said tray structure when in a closed position with respect thereto, said cover structure in said closed position comprising a top wall having a periphery including straight edges corresponding to the straight edges of said bottom wall, cover side walls folded downwardly from the straight edges of said top wall, each of two adjacent cover side walls having a periphery including an upper edge folded from and common with an associated top wall edge, a lower free edge spaced from the upper edge thereof and opposite end edges extending between the upper and lower edges thereof, said two adjacent cover side walls extending downwardly and outwardly from said top wall within angularly related planes with adjacent end edges thereof in spaced apart relation, and means interconnecting said cover side walls including a corner wall extending downwardly and outwardly from said top wall between the two adjacent spaced apart end edges of the two adjacent cover side walls within a plane extending at an angle with respect to the angularly related planes of said two adjacent cover side walls, said corner wall and said two adjacent cover side walls extending downwardly and outwardly beyond the upper edges of two adjacent interconnected tray side walls, and means acting between said tray side walls and said cover side walls for (1) retaining said cover structure in said closed position with respect to the open top of said tray structure and (2) enabling said cover structure to be moved out of said closed position to provide access to said tray structure through the open top thereof, said cover structure retaining means including opening means formed in said corner wall and tab means formed from a portion of carton material defining the tray structure at the interconnection of said two adjacent tray side walls, said corner wall including a portion of carton material extending downwardly and outwardly from said opening means in a position to be interengaged during the movement of the cover structure into said closed position with the portion of carton material defining the tab means such that at least one carton material portion of the two interengaging carton material portions deflects by virtue of the interengagement and is freed with a snap action when said cover structure reaches its closed position enabling said tab means to extend upwardly and outwardly through said opening means to thereby yieldingly retain said two adjacent cover side walls against general upward movement with respect to the associated two adjacent tray side walls.

2. A carton as defined in claim 1 wherein said tray structure and said cover structure are erected from a single cut and scored blank of carton material and said cover structure retaining means includes an integral fold of carton material along (1) a lower edge of a cover side wall other than said two adjacent cover side walls and (2) an upper edge of an tray side wall other than said two adjacent cover side walls.

3. A carton as defined in claim 2 wherein said tray structure and said cover structure are operable to be positioned in an opened position wherein said top wall is disposed in a common plane with said bottom wall, the angular inclinations of said side walls being such that the interconnected tray and cover structures are operable to be disposed in a nested stacked relation with a plurality of similar interconnected tray and cover structures.

4. A carton as defined in claim 3 wherein said means interconnecting said cover side walls includes flaps connecting ends of said other cover side wall with opposite end edges of said two adjacent cover side walls other than the two adjacent end edges thereof.

5. A carton as defined in claim 3 wherein said cover side walls include a pair of cover side walls between said two adjacent cover side walls and said other cover side wall, said means interconnecting said cover side walls includes flaps connecting ends of said pair of cover side walls with (1) opposite end edges of said two adjacent cover side walls other than the two adjacent end edges thereof and (2) ends of said other cover side wall.

6. A carton as defined in claim 3 wherein said cover side walls include a fourth cover side wall between one of said two adjacent cover side walls and said other cover side wall extending in a plane angularly related to the plane of said one cover side wall, said means interconnecting said cover side walls including (1) a second corner wall extending downwardly and outwardly from said top wall between (A) an end edge of one of said two adjacent cover side walls other than the adjacent end edge thereof and (B) an end of said fourth cover side wall and (2) flaps between the ends of said other cover side wall and (A) an end edge of the other of said two adjacent cover side walls other than the adjacent end edge thereof and (B) an opposite end of said fourth cover side wall, said second corner wall extending in a plane related angularly with respect to the angularly related planes of said fourth cover side wall and said one cover side wall.

7. A carton as defined in claim 1 wherein said opening means is defined by a generally U-shaped cut in said corner wall and means defining a straight fold line between the ends of the U-shaped cut, the portion of the carton material within the U-shaped cut and fold line forming an opening in said corner wall when folded out of the plane of the corner wall.

8. A carton as defined in claim 1 wherein said opening means is defined by removing a portion of the carton material forming said corner wall.

9. A carton as defined in claim 1 wherein the portion of carton material defining said tab means includes adjacent corner sections along the upper edges of said two adjacent tray side walls.

10. A carton as defined in claim 9 wherein each of said corner sections is rounded downwardly from the upper edge of the associated tray side wall.

11. A carton as defined in claim 10 wherein said corner sections are interconnected and an opening is formed therebelow to define the lower edges of the tab means.

12. A carton as defined in claim 10 wherein said corner sections bulge outwardly along the ends of said two adjacent tray side walls to form a pair of spaced tabs shaped to enter said opening means.

13. A carton as defined in claim 10 wherein said means interconnecting said tray side walls includes a connecting flap folded from an adjacent end of one of said two adjacent tray side walls and fixed to the other of said two adjacent tray side walls along the adjacent end thereof so as to define a triangular corner wall between the ends of said two tray side walls below the corner sections thereof.

14. A carton as defined in claim 1 wherein said tray structure and said cover structure are separate and formed from two separate blanks of sheet material.

15. A carton erected from carton material in cut and scored blank form, said carton comprising a lower tray structure comprising a bottom wall having a periphery including a plurality of straight edges, tray side walls folded upwardly from the straight edges of said bottom wall, means interconnecting adjacent tray side walls so that upper edges thereof define an open top for said tray structure, a separate cover structure for covering the open top of said tray structure when in a closed position with respect thereto, said cover structure in said closed position comprising a top wall having a periphery including straight edges corresponding to the straight edges of said bottom wall, cover side walls folded downwardly from the straight edges of said top wall, each of said cover side walls having a periphery including an upper edge folded from and common with an associated top wall edge, a lower free edge spaced from the upper edge thereof and opposite end edges extending between the upper and lower edges thereof, each pair of adjacent cover side walls extending downwardly and outwardly from said top wall within angularly related planes with adjacent end edges thereof in spaced apart relation, and means interconnecting said cover side walls including a corner wall extending downwardly and outwardly from said top wall between the adjacent spaced apart end edges of each pair of adjacent cover side walls within a plane extending at an angle to the angularly related planes of the associated pair of adjacent cover side walls, said corner walls and said cover side walls extending downwardly and outwardly beyond the upper edges of associated interconnected tray side walls, and means acting between said tray side walls and said cover side walls for (1) retaining said cover structure in said closed position with respect to the open top of said tray structure and (2) enabling said cover structure to be moved out of said closed position to provide access to said tray structure through the open top thereof, said cover structure retaining means including opening means formed in each of said corner walls and tab means associated with each opening means formed from a portion of carton material defining the tray structure at the interconnection of an associated pair of adjacent tray side walls, each of said corner walls including a portion of carton material extending downwardly and outwardly from the opening means formed therein in a position to be interengaged during the movement of the cover structure into said closed position with the portion of carton material defining the associated tab means such that at least one carton material portion of each two interengaging carton material portions deflects by virtue of the interengagement and is freed with a snap action when said cover structure reaches its closed position enabling each tab means to extend upwardly and outwardly through an associated opening means to thereby yieldingly retain said cover side walls against general upward movement with respect to the tray side walls.

16. A flat blank of carton material cut and scored to be erected into a carton, said flat blank comprising a tray blank section comprising a bottom wall having a periphery defined by a plurality of straight edges, a plurality of tray side walls hinged along the straight edges of said bottom wall so as to be folded in upstanding relation with respect to said bottom wall when erected, each of said tray side walls having a periphery including an inner edge hingedly connected with an associated bottom wall edge, an outer edge spaced from the inner edge thereof and opposite end edges extending between the inner and outer edges thereof, and tray flaps hinged to the end edges of said tray side walls for interconnecting by adhesive adjacent upstanding tray side walls so that the outer edges thereof define an open top for the tray structure erected by folding the tray side walls from said bottom wall, a cover blank section comprising a top wall having a periphery defined by straight edges corresponding to the straight edges of said bottom wall, a plurality of cover side walls hinged along the straight edges of said top wall, each of said cover side walls having a periphery including an inner edge hingedly connected with the associated top wall edge, a outer edge spaced from the inner edge thereof and opposite end edges extending between the inner and outer edges thereof, two adjacent cover side walls being foldable along the inner edges thereof to extend outwardly from said top wall within angularly related planes with adjacent end edges thereof in spaced apart relation when erected, cover flaps hinged to the end edges of said cover side walls for interconnecting by adhesive said cover side walls to form an erected cover structure, said cover flaps providing a corner wall hingedly connected with one of the two adjacent spaced apart end edges of the two adjacent cover side walls so as to be folded into a plane extending at an angle with respect to the angularly related planes of said two adjacent cover side walls when erected, an outer edge of one of said cover side walls other than said two adjacent cover side walls being hingedly connected with a corresponding outer edge of a corresponding tray side wall so as to enable the erected cover structure to pivot with respect to the erected tray structure between (1) an open position wherein the tray structure is open to access through the open top thereof, and (2) a closed position wherein said cover structure closes the open top of the erected tray structure, said corner wall having means defining an opening therein, a portion of carton material defining the tray structure at the interconnection of two adjacent tray side walls associated with said two adjacent cover side walls forming tab means for cooperating with the opening in said corner wall, said corner wall when said cover structure is moved towards said closed position including a portion of carton material extending downwardly and outwardly from said opening in a position to be interengaged during the movement of the cover structure into said closed position with the portion of carton material defining the tab means such that at least one carton material portion of the two interengaging carton material portions deflects by virtue of the interengagement and is freed with a snap action when said cover structure reaches its closed position enabling said tab means to extend upwardly and outwardly through said opening to thereby yieldingly retain said two adjacent cover side walls against general upward movement with respect to the associated two adjacent tray side walls.

17. A flat blank as defined in claim 16 wherein said means interconnecting said cover side walls includes flaps for connecting ends of said other cover side wall with opposite end edges of said two adjacent cover side walls other than the two adjacent end edges thereof.

18. A flat blank as defined in claim 16 wherein said cover side walls include a pair of cover side walls between said two adjacent cover side walls and said other cover side wall, said means interconnecting said cover side walls includes flaps for connecting ends of said pair of cover side walls with (1) opposite end edges of said two adjacent cover side walls other than the two adjacent end edges thereof and (2) ends of said other cover side wall.

19. A flat blank as defined in claim 16 wherein said cover side walls include a fourth cover side wall between one of said two adjacent cover side walls and said other cover side wall extending in a plane angularly related to the plane of said one cover side wall, said means interconnecting said cover side walls including (1) a second corner wall which when erected extends downwardly and outwardly from said top wall between (A) an end edge of one of said two adjacent cover side walls other than the adjacent end edge thereof and (B) an end of said fourth cover side wall and (2) flaps between the ends of said other cover side wall and (A) an end edge of the other of said two adjacent cover side walls other than the adjacent end edge thereof and (B) an opposite end of said fourth cover side wall, said second corner wall extending in a plane related angularly with respect to the angularly related planes of said fourth cover side wall and said one cover side wall.

20. A flat blank as defined in claim 16 wherein said opening means is defined by a generally U-shaped cut in said corner wall and means defining a straight fold line between the ends of the U-shaped cut, the portion of the carton material within the U-shaped cut and fold line forming an opening in said corner wall when folded out of the plane of the corner wall.

21. A flat blank as defined in claim 16 wherein said opening means is defined by removing a portion of the carton material forming said corner wall.

22. A flat blank as defined in claim 16 wherein the portion of carton material defining said tab means includes adjacent corner sections along the upper edges of said two adjacent tray side walls.

23. A flat blank as defined in claim 22 wherein each of said corner sections is rounded downwardly from the upper edge of the associated tray side wall.

24. A flap blank as defined in claim 23 wherein said corner sections are interconnected and an opening is formed therebelow to define the lower edges of the tab means.

25. A carton as defined in claim 23 wherein said corner sections bulge outwardly along the ends of said two adjacent tray side walls to form a pair of spaced tabs shaped to enter said opening means.

26. A pair of separate flat blanks of carton material cut and scored to be separately erected and cooperatively interengaged to form a carton, said flat blanks comprising a tray blank comprising a bottom wall having a periphery defined by a plurality of straight edges, a plurality of tray side walls hinged along the straight edges of said bottom wall so as to be folded in upstanding relation with respect to said bottom wall when erected, each of said tray side walls having a periphery including an inner edge hingedly connected with an associated bottom wall edge, an outer edge spaced from the inner edge thereof and opposite end edges extending between the inner and outer edges thereof, and flaps hinged to the end edges of said tray side walls for interconnecting by adhesive adjacent upstanding tray side walls so that the outer edges thereof define an open top for the tray structure erected by folding the tray side walls from said bottom wall, a cover blank comprising a top wall having a periphery defined by straight edges corresponding to the straight edges of said bottom wall, a plurality of cover side walls hinged along the straight edges of said top wall, each of said cover side walls having a periphery including an inner edge hingedly connected with the associated top wall edge, a outer edge spaced from the inner edge thereof and opposite end edges extending between the inner and outer edges thereof, each pair of adjacent cover side walls being foldable along the inner edges thereof to extend outwardly from said top wall within angularly related planes with adjacent end edges thereof in spaced apart relation when erected, wall sections hinged to the end edges of said cover side walls for interconnecting by adhesive said cover side walls to form an erected cover structure, said wall sections providing a corner wall hingedly connected with one of the two adjacent spaced apart end edges of each pair of adjacent cover side walls so as to be folded into a plane extending at an angle with respect to the angularly related planes of the associated pair of adjacent cover side walls when erected, each of said corner walls having means defining an opening therein, a portion of carton material defining the tray structure at the interconnection of each pair of adjacent tray side walls forming tab means for cooperating with an opening in an associated corner wall, each corner wall when said cover structure is moved towards a closed position with respect to said tray structure including a portion of carton material extending downwardly and outwardly from said opening in a position to be interengaged during the movement of the cover structure into said closed position with the associated portion of carton material defining the tab means such that at least one carton material portion of each two associated interengaging carton material portions deflects by virtue of the interengagement and is freed with a snap action when said cover structure reaches its closed position enabling each said tab means to extend upwardly and outwardly through the associated opening to thereby yieldingly retain the associated pairs of adjacent cover side walls against general upward movement with respect to the associated pairs of adjacent tray side walls.

* * * * *